US009458622B1

(12) United States Patent
Orr

(10) Patent No.: US 9,458,622 B1
(45) **Date of Patent: *Oct. 4, 2016**

(54) PORTABLE STRUCTURE

(71) Applicant: James R. Orr, Davenport, IA (US)

(72) Inventor: James R. Orr, Davenport, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/879,320

(22) Filed: Oct. 9, 2015

Related U.S. Application Data

(63) Continuation of application No. 14/278,617, filed on May 15, 2014, now Pat. No. 9,187,892, which is a continuation of application No. 13/966,991, filed on Aug. 14, 2013, now Pat. No. 8,756,876, which is a continuation of application No. 13/743,860, filed on Jan. 17, 2013, now abandoned, which is a continuation of application No. 13/542,073, filed on Jul. 5, 2012, now abandoned, which is a continuation of application No. 13/030,990, filed on Feb. 18, 2011, now Pat. No. 8,291,648.

(60) Provisional application No. 61/305,746, filed on Feb. 18, 2010.

(51) Int. Cl.

| | |
|---|---|
| ***E04B 1/32*** | (2006.01) |
| ***E04B 1/343*** | (2006.01) |
| ***E04B 1/19*** | (2006.01) |
| ***E04B 1/41*** | (2006.01) |
| ***E04H 1/02*** | (2006.01) |
| ***E04H 1/12*** | (2006.01) |
| ***E04H 1/00*** | (2006.01) |

(52) U.S. Cl.

CPC ..... *E04B 1/34384* (2013.01); *E04B 1/19* (2013.01); *E04B 1/3205* (2013.01); *E04B 1/34326* (2013.01); *E04B 1/34331* (2013.01); *E04B 1/34336* (2013.01); *E04B 1/40* (2013.01); *E04H 1/005* (2013.01); *E04H 1/02* (2013.01); *E04H 1/1205* (2013.01); *E04B 2001/1978* (2013.01); *E04H 2001/1283* (2013.01)

(58) Field of Classification Search

CPC ..... E04B 1/19; E04B 1/34331; E04B 1/40; E04B 1/3205; E04B 1/34326; E04B 1/34336; E04B 1/34384; E04B 2001/1978; E04H 1/005; E04H 1/02; E04H 1/1205; E04H 2001/1283

USPC ..... 52/63, 79.1, 79.4, 79.5, 79.9, 86; 135/88.13, 124, 906, 913

See application file for complete search history.

(56) References Cited

U.S. PATENT DOCUMENTS 674,920 A * 5/1901 Jones ..... 135/137
1,608,242 A * 11/1926 Sava ..... 135/126

(Continued)

*Primary Examiner* — James Buckle, Jr.
(74) *Attorney, Agent, or Firm* — Hamilton IP Law, PC; Jay R. Hamilton; Charles A. Damschen

(57) ABSTRACT

The portable structure will generally have a pod from which a suite frame and suite may be deployed. The suite will allow personnel to administer to many critical demands and activities. The portable structure may be deployed upon any terrain, whether level or uneven, rigid or soft, and both the pod and the suite may be leveled independently. Additionally, the portable structure may incorporate at least one cocoon section wherein the cocoon section comprises at least one interior layer contacting a mesh covering placed over the suite frame, at least one thermal layer affixed to the interior layer, wherein the thermal layer includes heat adding and heat removal members capable of removing or adding heat to the mesh covering or a substance adjacent the at least one thermal layer and at least one exterior layer affixed to the thermal layer.

13 Claims, 36 Drawing Sheets

(56) References Cited

U.S. PATENT DOCUMENTS

| | | | | | |
|---|---|---|---|---|---|
| 2,357,056 | A | * | 8/1944 | Nelson | 135/137 |
| 2,493,833 | A | * | 1/1950 | Reynolds | 114/361 |
| 2,666,507 | A | * | 1/1954 | Ruark | 52/643 |
| 2,693,195 | A | * | 11/1954 | Frieder et al. | 135/122 |
| 2,765,499 | A | * | 10/1956 | Couse | 52/66 |
| 2,827,138 | A | * | 3/1958 | Roy, Jr. | 52/86 |
| 3,064,667 | A | * | 11/1962 | Marino | 135/131 |
| 3,217,722 | A | * | 11/1965 | Heise | 52/63 |
| 3,363,938 | A | * | 1/1968 | Schultz | 296/65.05 |
| 3,424,178 | A | * | 1/1969 | Yazaki | 135/157 |
| 3,798,851 | A | * | 3/1974 | Utahara | 52/86 |
| 3,837,702 | A | * | 9/1974 | Case | 296/36 |
| 4,012,867 | A | * | 3/1977 | Lainchbury et al. | 47/17 |
| 4,055,030 | A | * | 10/1977 | Earnshaw | 52/86 |
| 4,070,846 | A | * | 1/1978 | Sohlberg | 52/641 |
| 4,715,159 | A | * | 12/1987 | Hijazi | 52/646 |
| 4,844,109 | A | * | 7/1989 | Navarro | 135/129 |
| 4,885,879 | A | * | 12/1989 | Plantier | 52/63 |
| 5,005,896 | A | * | 4/1991 | Li | 296/100.18 |
| 5,333,421 | A | * | 8/1994 | McKenna | 52/86 |
| 5,335,684 | A | * | 8/1994 | Hanninen | 135/124 |
| 5,338,084 | A | * | 8/1994 | Wardell | 296/105 |
| 5,524,953 | A | * | 6/1996 | Shaer | 296/100.12 |
| 5,595,203 | A | * | 1/1997 | Espinosa | 135/124 |
| 5,598,668 | A | * | 2/1997 | Isom | 52/86 |
| 5,867,948 | A | * | 2/1999 | Liu | 52/80.1 |
| 6,026,613 | A | * | 2/2000 | Quiring et al. | 52/63 |
| 6,070,925 | A | * | 6/2000 | Moldofsky | 296/26.08 |
| 6,640,505 | B1 | * | 11/2003 | Heierli | 52/86 |
| 6,679,009 | B2 | * | 1/2004 | Hotes | 52/86 |
| 6,712,414 | B2 | * | 3/2004 | Morrow | 296/26.01 |
| 6,758,014 | B2 | * | 7/2004 | Chen | 52/63 |
| 6,763,633 | B2 | * | 7/2004 | Cote | 52/71 |
| 7,007,706 | B2 | * | 3/2006 | Pinnell et al. | 135/88.01 |
| 7,021,694 | B1 | * | 4/2006 | Roberts et al. | 296/100.18 |
| 7,100,625 | B2 | * | 9/2006 | Valles | 135/88.13 |
| 7,396,064 | B2 | * | 7/2008 | Hicks | 296/26.01 |
| 7,418,802 | B2 | * | 9/2008 | Sarine et al. | 52/79.5 |
| 7,520,290 | B2 | * | 4/2009 | Dalbo | 135/88.07 |
| 7,681,941 | B2 | * | 3/2010 | Freeman et al. | 296/168 |
| 7,798,547 | B2 | * | 9/2010 | Antaya | 296/26.13 |
| 7,930,857 | B2 | * | 4/2011 | Pope | 52/67 |
| 7,980,029 | B2 | * | 7/2011 | Ahmedy | 52/71 |
| 8,001,987 | B2 | * | 8/2011 | Williams | 135/136 |
| 2003/0005953 | A1 | * | 1/2003 | Erbetta et al. | 135/151 |
| 2005/0138867 | A1 | * | 6/2005 | Zhao | 52/79.1 |
| 2005/0144858 | A1 | * | 7/2005 | Bothun et al. | 52/79.1 |
| 2009/0090406 | A1 | * | 4/2009 | Maximilien et al. | 135/88.13 |
| 2010/0170162 | A1 | * | 7/2010 | Pfeiffer | 52/2.24 |
| 2010/0192481 | A1 | * | 8/2010 | Shen et al. | 52/79.5 |
| 2010/0319742 | A1 | * | 12/2010 | Prusmack | 135/88.13 |
| 2011/0120026 | A1 | * | 5/2011 | Hache | 52/79.5 |
| 2011/0214362 | A1 | * | 9/2011 | Huang | 52/79.5 |

* cited by examiner

PORTABLE STRUCTURE

CROSS REFERENCE TO RELATED APPLICATIONS

The present application claims priority from and is a continuation of U.S. patent application Ser. No. 14/278,617 filed on May 15, 2014, which application claimed priority from and was a continuation of U.S. patent application Ser. No. 13/966,991 filed on Aug. 14, 2013 (now U.S. Pat. No. 8,756,876), which application is a continuation of and claimed priority from U.S. patent application Ser. No. 13/743,860 filed on Jan. 17, 2013 (now abandoned), which application was a continuation of and claimed priority from U.S. patent application Ser. No. 13/542,073 filed on Jul. 5, 2012 (now abandoned), which application claimed priority from and was a continuation of U.S. patent application Ser. No. 13/030,990 filed on Feb. 18, 2011 (now U.S. Pat. No. 8,291,648), which application claimed priority from provisional U.S. Pat. App. No. 61/305,746 filed on Feb. 18, 2010, all of which applications are incorporated by reference herein in their entireties.

FIELD OF INVENTION

The present invention relates to methods and apparatuses for providing a portable structure to any type of terrain. More specifically, the invention provides a rapid response emergency multi-purpose unit for providing shelter and services to difficult terrain.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

AUTHORIZATION PURSUANT TO 37 C.F.R. §1.171 (d)

A portion of the disclosure of this patent document contains material which is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

BACKGROUND

Many times it is difficult or impossible to provide the appropriate medical care or other services to remote areas and/or areas having difficult terrain, such as mountains, jungles, and the like. The uneven terrain causes difficulty in erecting any sort of covered structure. The difficult terrain also prevents land vehicles from reaching those areas. Accordingly, an apparatus that is transportable and provides some shelter to remote areas during times of emergency is needed.

SUMMARY OF THE INVENTION

The portable structure will be well suited for many applications that may include but not limited to a triage hospital, decontamination facility, radiation free sanctuary, temporary housing or billeting, relief station, command center during a disaster, morgue, repair facility, communications center, forward observation facility, rescue and recovery facility, and staging area.

The portable structure may be insulated, and may be transported to any disaster area and in a matter of minutes. It may provide a full array of services for any natural disaster, terrorist attack, or other necessities. The portable structure may be fully operational within minutes, providing an insulated, clean, lighted, heated or cooled environment, which may be fully equipped, allowing the staff to perform on-site activities immediately. Depending on the size specified, this portable structure may be fully functional with ninety minutes.

It is an object of the portable structure to provide a rapid response emergency multi-purpose unit that may be towed to a site or deployed from the air.

It is another object of the portable structure to provide a portable structure that may be leveled on any type of uneven terrain.

All elements that will provide the physical equipments and services for an entire portable structure will be contained in a mobile transport container pod that may be transported by ground, sea or air.

The pod will be constructed with appropriate material and design such that the pod, once deployed and the equipment correctly positioned, will be become the nucleus of the entire portable structure.

The pod will be constructed in a manner that the components for the portable structure will be off-loaded and erected in a logical and predetermined manner and method.

The virgin pod is weather and water proof, and hermetically sealed to minimize contamination, damage, or pilferage to the critical elements contained in the pod during storage and deployment.

The pod will vary in size, shape, dimensions, and weight based on the special-ordered equipment and services requested by the client(s). The pod may have portable or retractable axle/wheel/tire assemblies allowing the pod, when the axle wheel/tire assemblies are deployed, to be transported on land.

The pod may be loaded and secured on a ship in a manner similar to the manner in which cargo containers are loaded on to container ships.

The pod may be loaded into cargo aircraft.

The pod may be airlifted by helicopter or other suitable means.

The pod, when deployed to a disaster location, may be placed on the ground whether the ground is level or uneven, hilly or flat, or is covered with snow or other liabilities.

Other objects of the portable structure will become apparent to those skilled in the art in light of the present disclosure.

BRIEF DESCRIPTION OF THE FIGURES

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limited of its scope, the invention will be described and explained with additional specificity and detail through the use of the accompanying drawings.

FIG. 17B provides a perspective view of a sleeve connector and vertical rail section prior to engagement there between.

DETAILED DESCRIPTION - LISTING OF ELEMENTS

Figure 1:
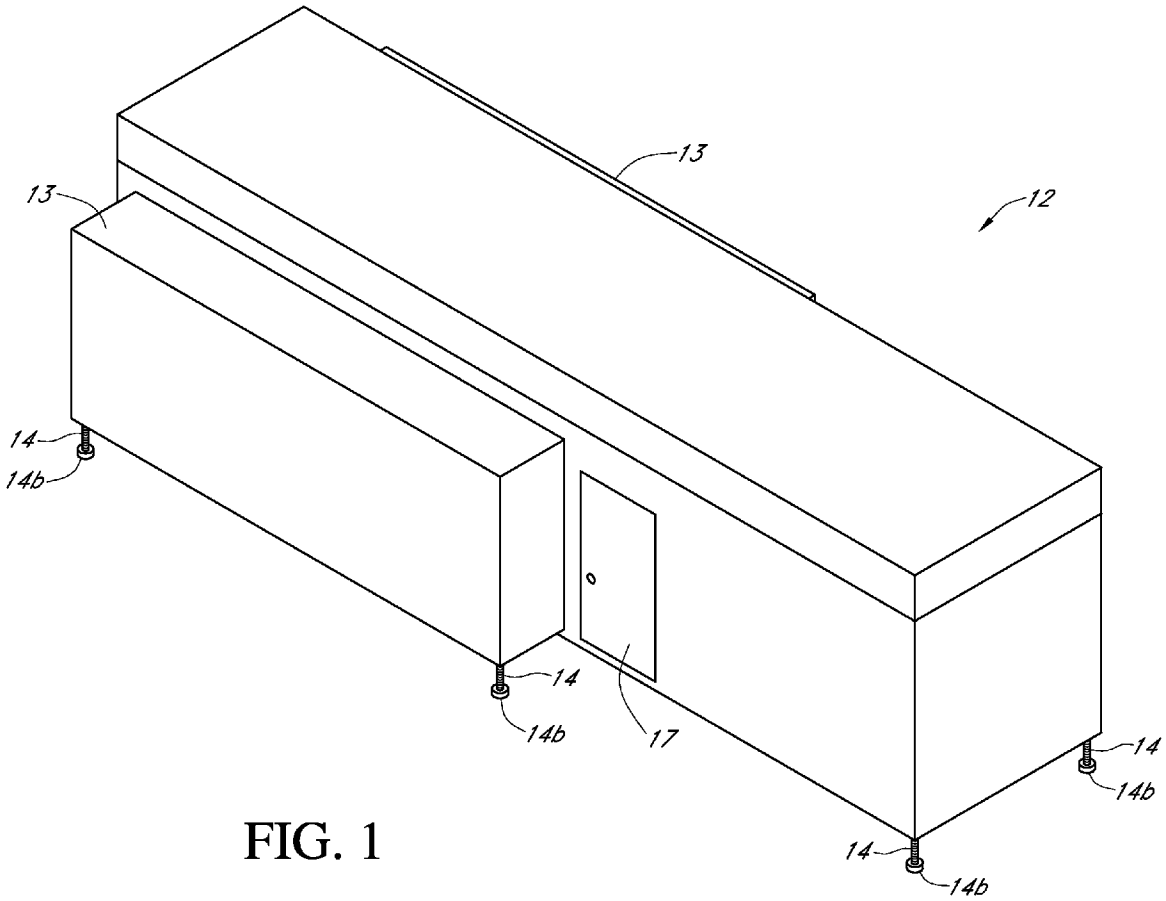
FIG. 1 provides a perspective view of the pod with the slide outs extended and the pod leveling screws deployed.

| ELEMENT DESCRIPTION | ELEMENT # |
|---|---|
| Generator | 2 |
| HVAC | 4 |
| Control panel | 6 |
| Breaker panel | 7 |
| Exterior access panel | 8 |
| Water control center | 9 |
| Portable structure | 10 |
| Pod | 12 |
| Slide out | 13 |
| Leveling screw | 14 |
| Leveling screw block | 14a |
| Leveling screw pad | 14b |
| Leveling screw retainer | 15 |
| Side port | 15a |
| Bottom port | 15b |
| Pod base | 16 |
| Pod access door | 17 |
| Shelving | 18 |
| Catwalk | 19 |
| Ladder | 19a |
| Suite frame | 20 |
| Ground rail | 21 |
| Ground rail support | 21a |
| Support pad | 21b |
| Vertical rail section | 22 |
| Vertical rail roller | 22a |
| Arch support | 23 |
| Upright | 24 |
| Fixture | 24a |
| Fixture aperture | 24b |
| Cross member | 25 |
| Tab | 25a |
| Sleeve connector | 26 |
| Pin | 26a |
| Aperture | 26b |
| Outside floor support | 27a |
| Inside floor support | 27b |
| Center floor member | 27c |
| Horizontal cable | 28a |
| Vertical cable | 28b |
| Floor support sleeve | 29a |
| Floor support clamp | 29b |
| Floor support platform | 29c |
| Floor support arm | 29d |
| Equalizer | 29e |
| Suite | 30 |
| Treatment Area Support | 31 |
| Treatment Area | 32 |
| Light Source | 33 |
| Electrical Conduit | 34 |
| Electrical Outlet | 35 |
| HVAC Ductwork | 36 |
| Mesh Covering | 38 |
| Cocoon Section | 40 |
| Suite Access Door | 42 |
| Suite Canopy | 44 |
| Cocoon Canopy Section | 46 |
| Floor Sheet | 48 |

DETAILED DESCRIPTION

1. Description of Illustrative Embodiment

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

Referring now to the drawings, wherein like reference numerals designate identical or corresponding parts throughout the several views, FIG. 1 illustrates a first embodiment of a pod 12 having two slide outs 13, which are shown in the extended position in FIG. 1. The dimensions of the pod 12 and slide outs 13 will vary depending on the specific embodiment of the portable structure 10, and therefore do not limit the scope of the portable structure 10 as disclosed and claimed herein. In one embodiment of the portable structure 10 shown in FIGS. 5 and 6, the slide outs 13 are approximately three feet wide and the pod 12 is eight feet wide. Accordingly, when the slide outs 13 are extended the overall width of the pod 12 is 14 feet. It is contemplated that the entire length of the pod 12 may be from twelve to forty five feet. However, the portable structure 10 is in no way limited by any dimensions of the pod 12, and the preceding are for illustrative purposes only.

Figure 2B:
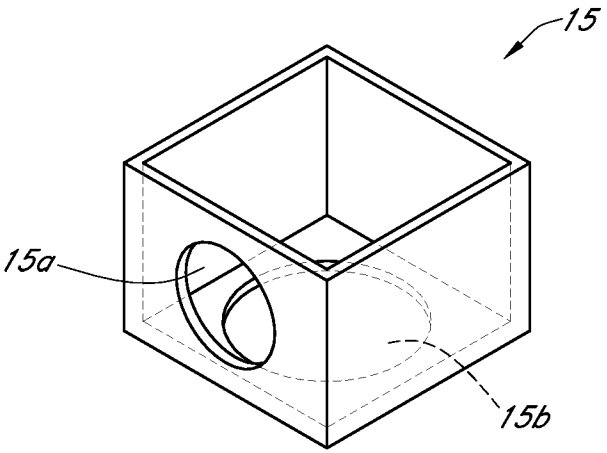
FIG. 2B provides a perspective view of the embodiment of the leveling screw pad shown in FIG. 2A.
Figure 2A:
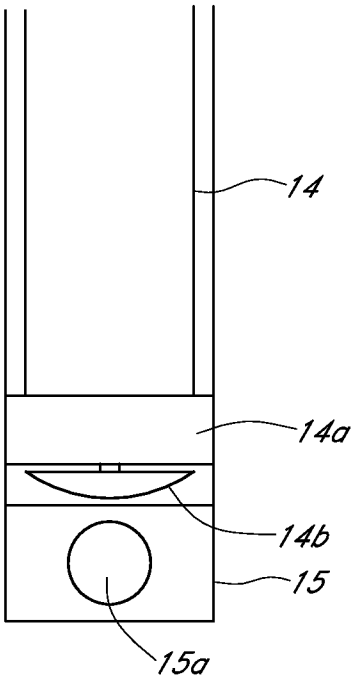
FIG. 2A provides a cutaway view of one embodiment of a leveling screw, leveling screw block, and leveling screw pad engaged with one another.
Figure 2D:
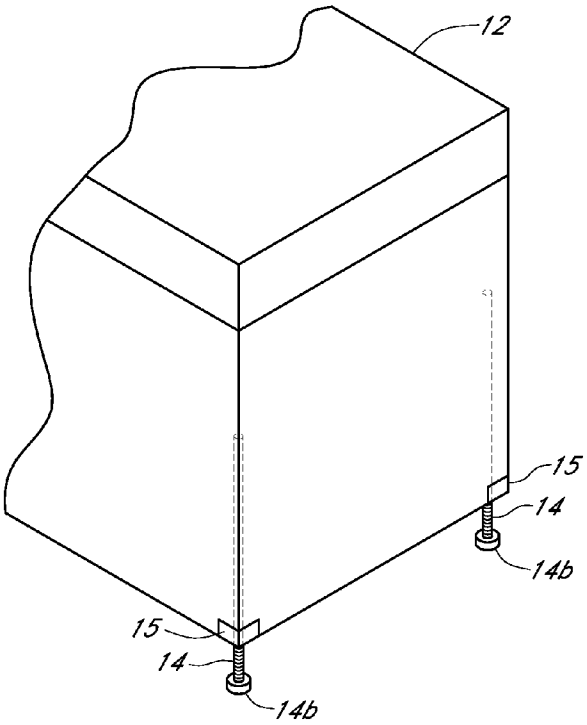
FIG. 2D provides a perspective view of one embodiment of a pod with two leveling screws partially extended.
Figure 2C:
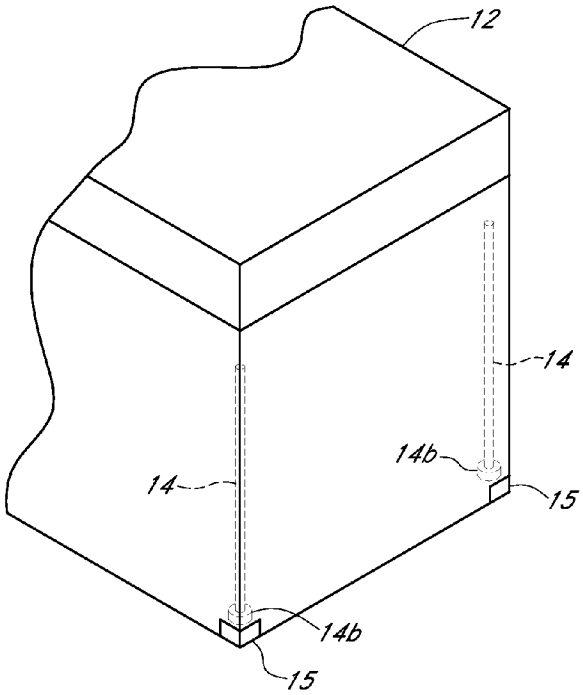
FIG. 2C provides a perspective view of one embodiment of a pod with two leveling screws fully retracted.

Each corner of the pod 12 may be equipped with a pod leveling screw 14 having a leveling screw pad 14*b* attached to one end thereof as shown in FIGS. 2A, 2C, and 2D. A laser level (not shown) and computer (not shown) in communication with a rotational power source (not shown) may be used to continually adjust the leveling screws 14 so that the pod 12 remains level through any settling that may occur upon deployment. The size of the leveling screw pads 14*b* will vary depending on the rigidity of the surface on which the pod 12 is placed. A portion of the leveling screw 14 may be engaged with the leveling screw block 14*a*, and the leveling screw block 14*a* may be securely engaged with the pod 12. A leveling screw retainer 15 may be placed at each bottom corner of the pod 12 and secured thereto. The leveling screw retainer 15 may be formed with a side port 15*a* for inspecting the leveling screw 14 and/or leveling screw pad 14*b*. The leveling screw retainer 15 may also formed with a bottom port 15*b* through which the leveling screw pad 14*b* may pass when deployed.

The pod leveling screws allow users to vary the distance between the pod 12 and the leveling screw pad 14*b*, which rests upon the surface on which the pod 12 is deployed. In this manner, the user may level the pod 12 and extremely uneven terrain. Pod leveling screws 14 may also be positioned out the outer corners of the slide outs 13 for additional structural support. Other arrangements of leveling screws 14, leveling screw pads 14*b*, and/or leveling screw retainers 15 exists, and any structure and/or method that allows a user to adequately level the pod 12 may be used without limitation.

All the components of the portable structure 10 may be configured to fit within the pod 12. Accordingly, the pod 12 may be delivered to the site at which it is needed, and the portable structure 10 may them be deployed from the materials contained within the pod 12, which is described in detail below. In assembling the portable structure 10, the pod 12 is first placed in the area in which services are needed and then the pod 12 is leveled. It is contemplated the pod 12 will most typically be of the dimensions and weight such that a helicopter may deliver the pod 12 to the area in which it is needed. Alternatively, the pod 12 may be configured as a trailer to a land vehicle.

Figure 3:
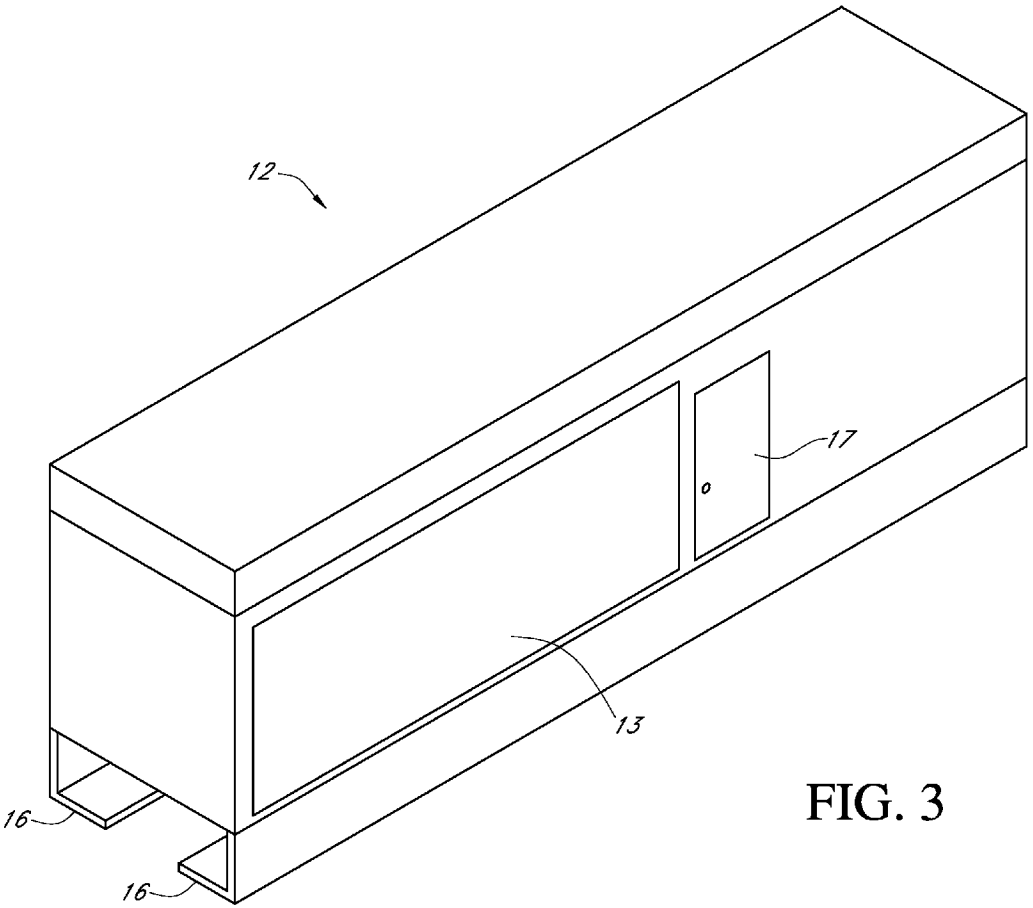
FIG. 3 provides a perspective view of the pod without the slide outs extended, wherein the pod base is expanded for use on soft terrain.

An embodiment of a pod 12 having an expanded pod base 16 is shown in the embodiment in FIG. 3. This embodiment would be especially useful on surfaces that are extremely soft or if the rigidity of the surface is unknown. Alternatively, the size of the leveling screw pads 14*b* could be increased to reduce the pressure they exert on the surface on which the pod 12 is deployed.

Figure 4:
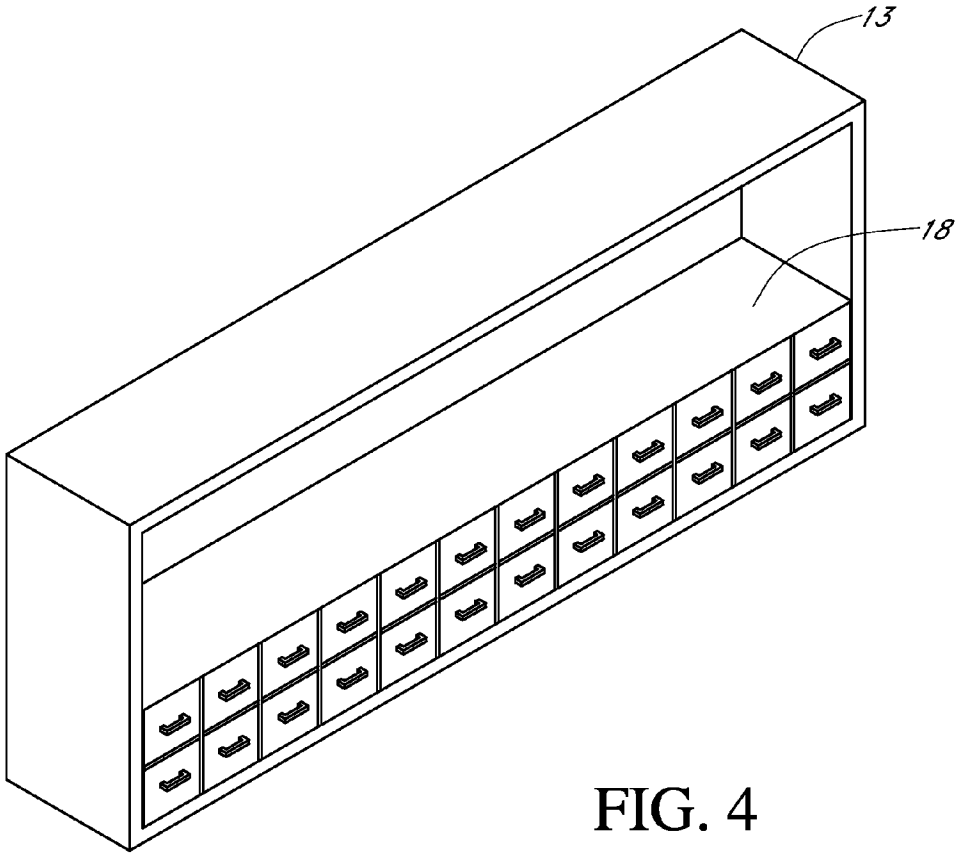
FIG. 4 provides a perspective view of one embodiment of the interior portion of one slide out.
Figure 5:
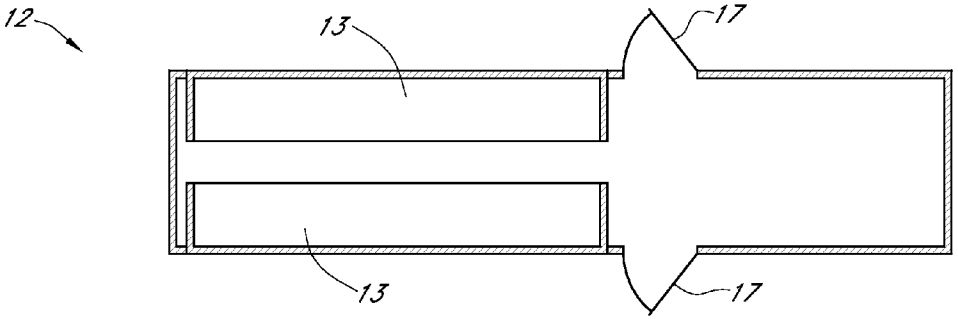
FIG. 5 provides a top view of one embodiment of the pod before the slide outs have been extended showing the relative dimensions of some elements thereof.
Figure 6:
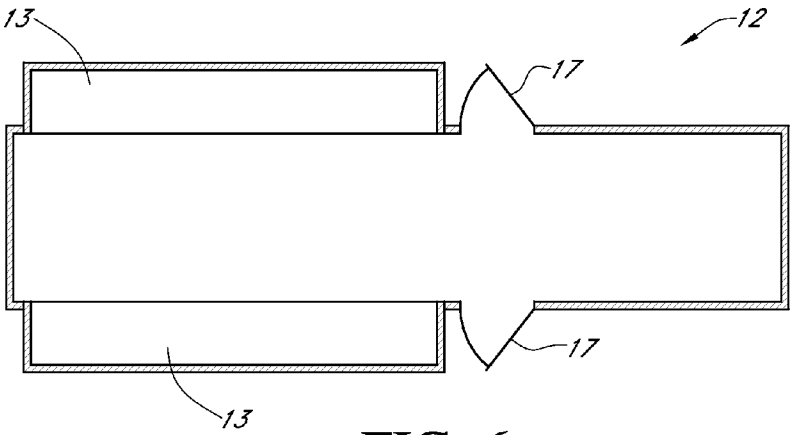
FIG. 6 provides an top view of one embodiment of the pod after the slide outs have been extended showing the relative dimensions of some elements thereof.
Figure 7:
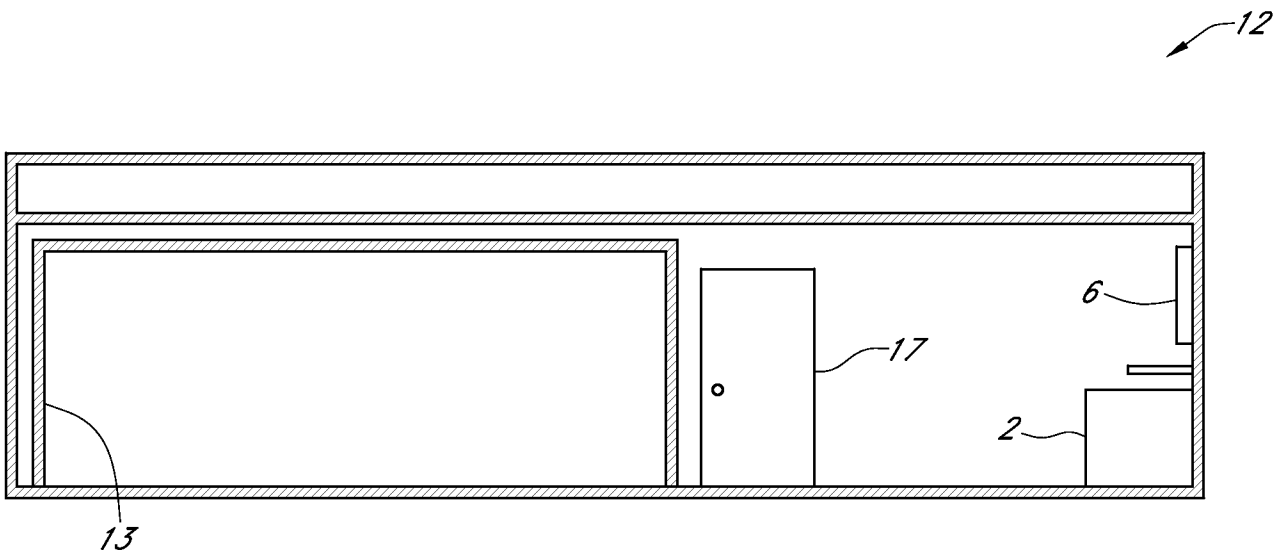
FIG. 7 provides a cutaway side view of one embodiment of the pod showing the relative dimensions and arrangement of some elements thereof.
Figure 8B:
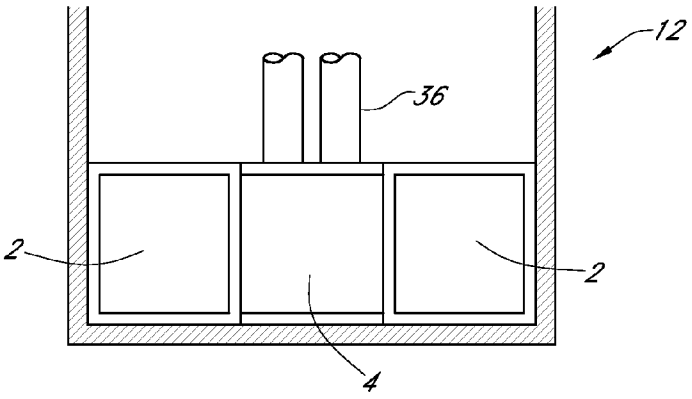
FIG. 8B provides a top view of a second arrangement of the generator and HVAC components within the pod.
Figure 8A:
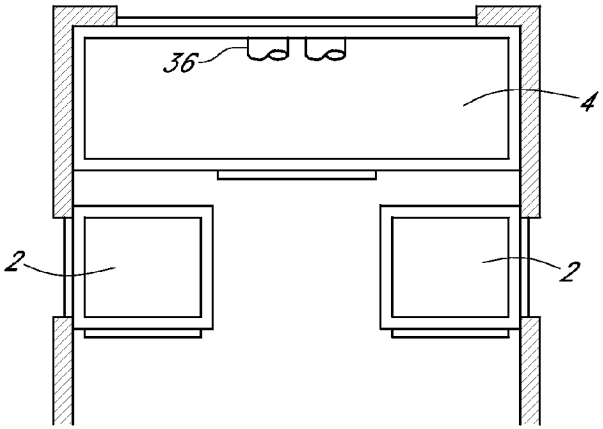
FIG. 8A provides a top view of a first arrangement of the generator and HVAC components within the pod.

The precise layout, equipment, and equipment placement within the portable structure 10 will vary from one embodiment to the next. In the embodiment shown in FIG. 4, shelving 18 may be positioned on the interior surface of one of the slide outs 13. As shown in FIG. 7, a portion at one end of the pod 12 may be designated for positioning some of the working elements of the portable structure 10, such as a generator 2, control panel 6, and other mechanical and/or electrical systems or controls. For convenience, a pod access door 17 may be positioned adjacent the area designated for working elements, as shown in FIGS. 5-7. Top views of two alternative arrangements of a generator 2 and HVAC 4 layout is shown in FIGS. 8A and 8B. As is apparent to those skilled in the art, HVAC ductwork 36 spans the distance from the HVAC 4 to other areas of the portable structure 10 requiring heating and/or cooling.

Figure 9A:
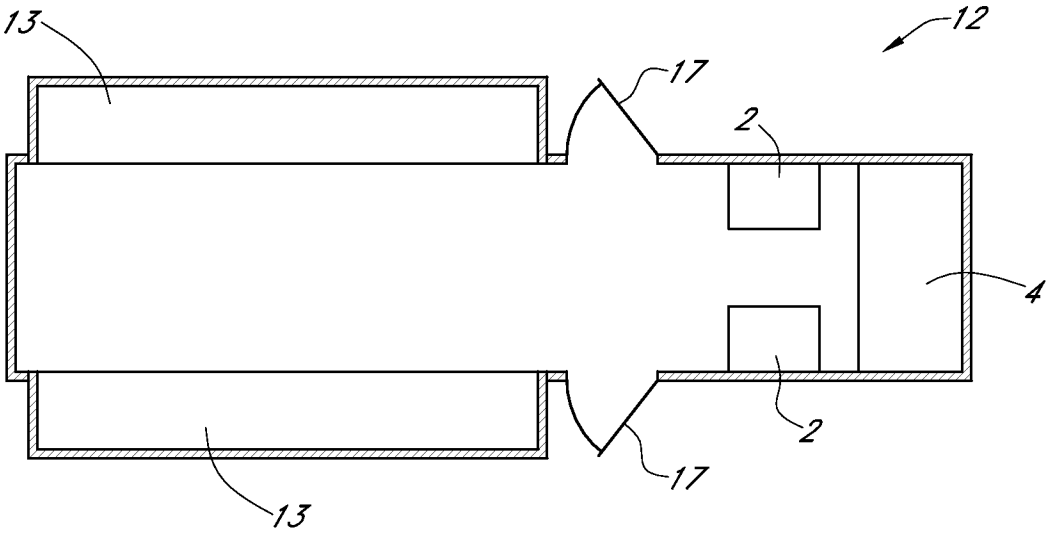
FIG. 9A provides a top view of one arrangement of the generator and HVAC components within the pod.
Figure 9B:
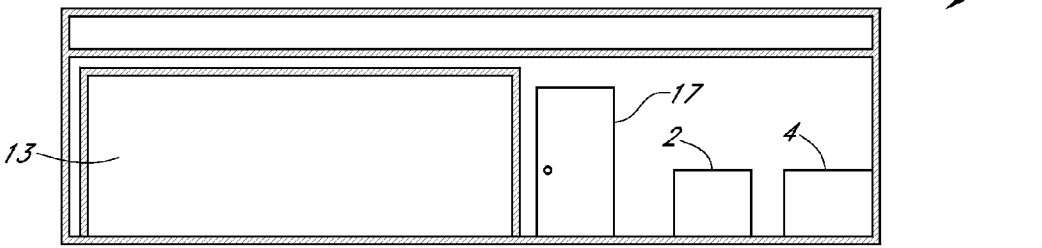
FIG. 9B provides a cutaway side view of the arrangement of the generator and HVAC components shown in FIG. 9A.
Figure 9C:
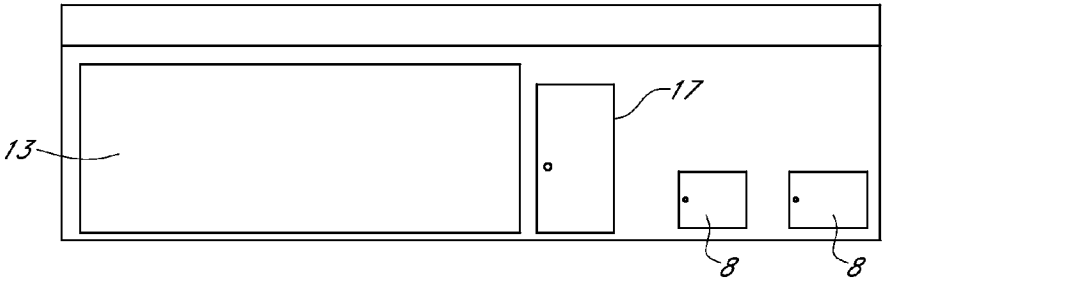
FIG. 9C provides an external side view of the pod have exterior access panels.

In certain embodiments, it may be beneficial for the pod 12 to be equipped with exterior access panels 8 for some of the mechanical and/or utility machinery. As shown in FIGS. 9A-9C, these panels may be placed adjacent the HVAC 4, control panel 6, and or the generators 2. The precise dimensions of the pod 12 and slide outs 13 vary, and the configuration of the HVAC 4, generators 2, control panel 6, and/or exterior access panels 8 may vary without departing from the spirit and scope of the portable structure 10.

Figure 10:
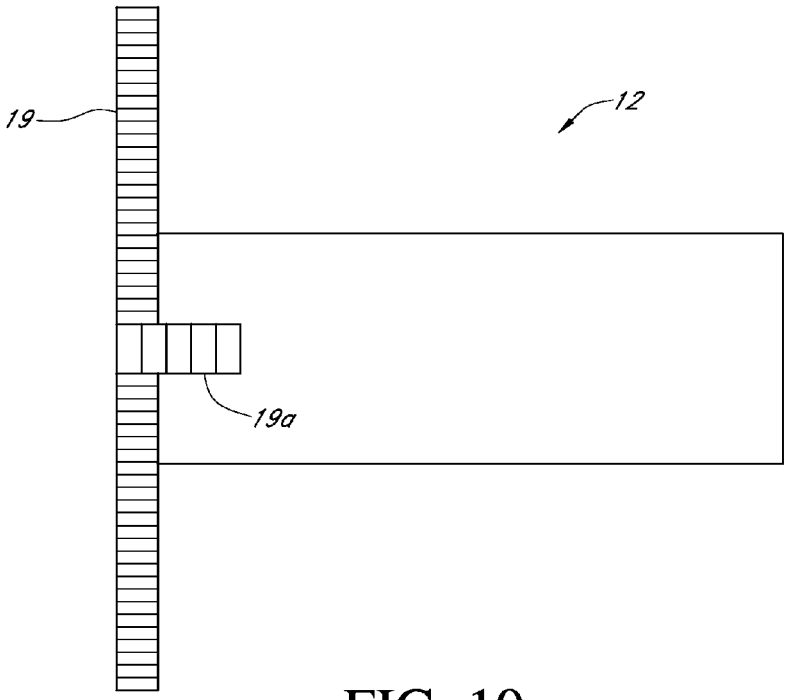
FIG. 10 provides a top view of the pod with the catwalk extended.
Figure 31:
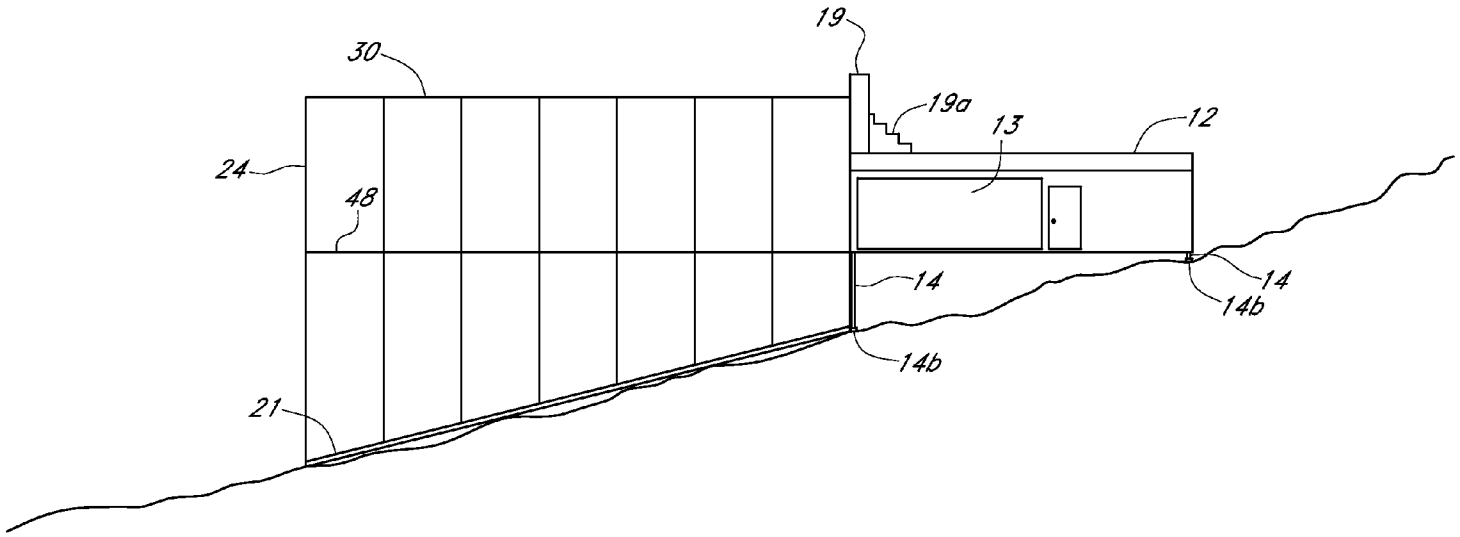
FIG. 31 is a side view of one embodiment of the suit frame erected and attached to a pod.

After the pod 12 is positioned and leveled, the catwalk 19 may be extended. Although not shown in the figures herein, it is contemplated that many applications of the portable structure 10 will include a plurality of cables attached to various portions of the catwalk 19 to increase the robustness and stability thereof. The catwalk 19 runs perpendicular to the longest side of the pod 12 in the embodiment shown in FIGS. 10 and 11 and is positioned on the end of the pod 12 opposite the generator 2, HVAC 4, and/or other mechanical and electrical controls. A ladder 19*a* may also be positioned adjacent the catwalk 19 for access to the upper exterior of the portable structure 10 as shown in FIG. 31. Typically, the length of the catwalk 19 is equal to the width of the suite frame 20, which is described in detail below.

Figure 12:
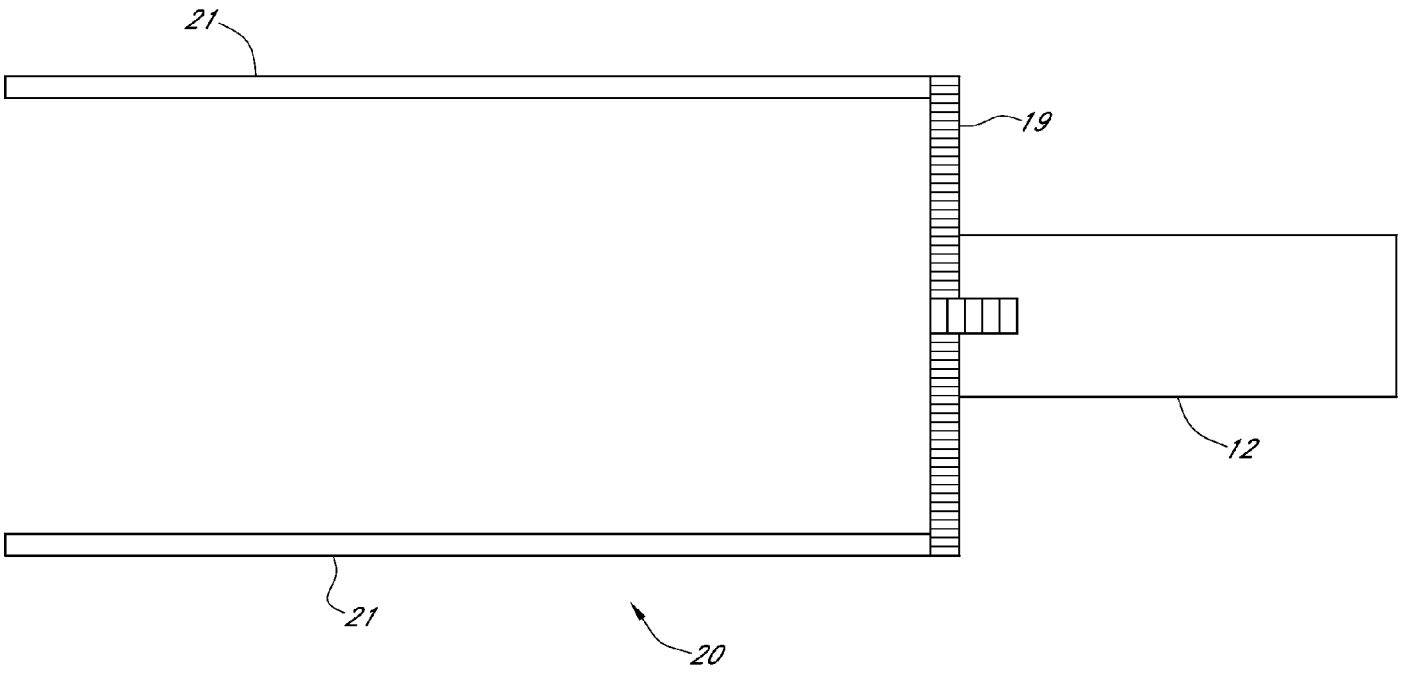
FIG. 12 provides a top view of the pod with the catwalk extended and shows two ground rails in relation thereto.
Figure 15B:
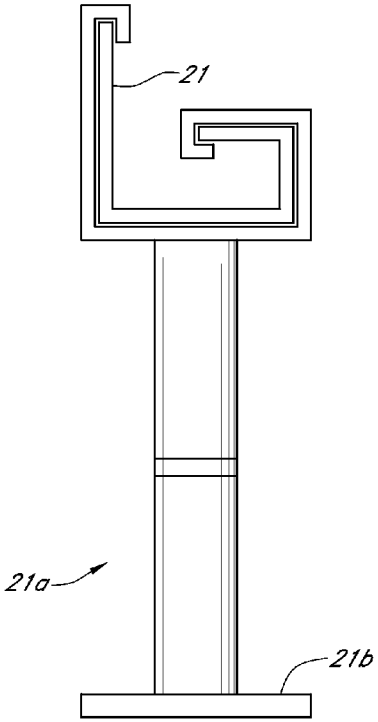
FIG. 15B provides an end view of one embodiment of a ground rail engaged with a ground rail support.
Figure 15A:
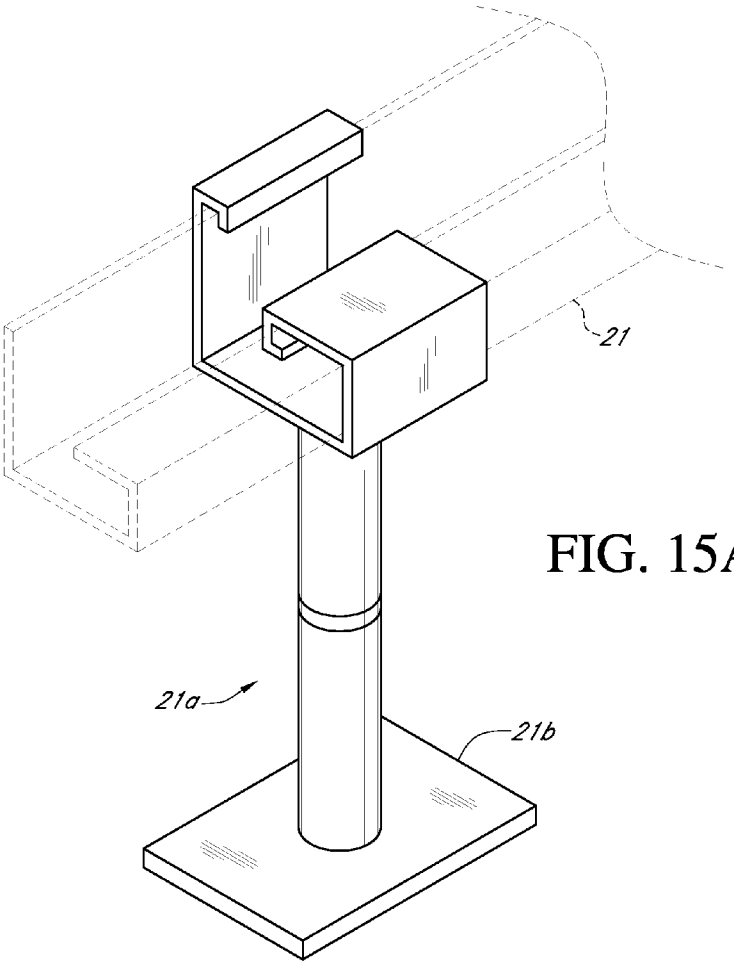
FIG. 15A provides a perspective view of one embodiment of a ground rail engaged with a ground rail support.

To begin construction of the suit frame 20, ground rails 21 may extend from the pod 12 spaced from one another by an amount equal to the length of the catwalk 19, as shown in FIG. 12. The distal ends of the ground rails 21 may be affixed to one another by a cross brace (not shown) to add strength to the suite frame 20. The ground rails 21 will be positioned below the cat walk 19 and may form the foundation for additional elements of the suite 30. If the terrain is uneven, ground rail supports 21*a* may be used to ensure each ground rail 21 will not be dislodged from the desired position. The ground rail supports 21*a* (as shown in FIGS. 15A and 15B) may be adjustable for height and may have ground pads 21*b* of varying size depending on the rigidity of the surface on which the ground rail supports 21*a* are placed. The ground rails 21 and/or ground rail supports 21*a* (if so equipped) support the suite 30, and therefore must be constructed of a suitably robust material, such as steel, iron, metal alloys, polymer materials, or any other suitable material known to those skilled in the art.

Figure 14:
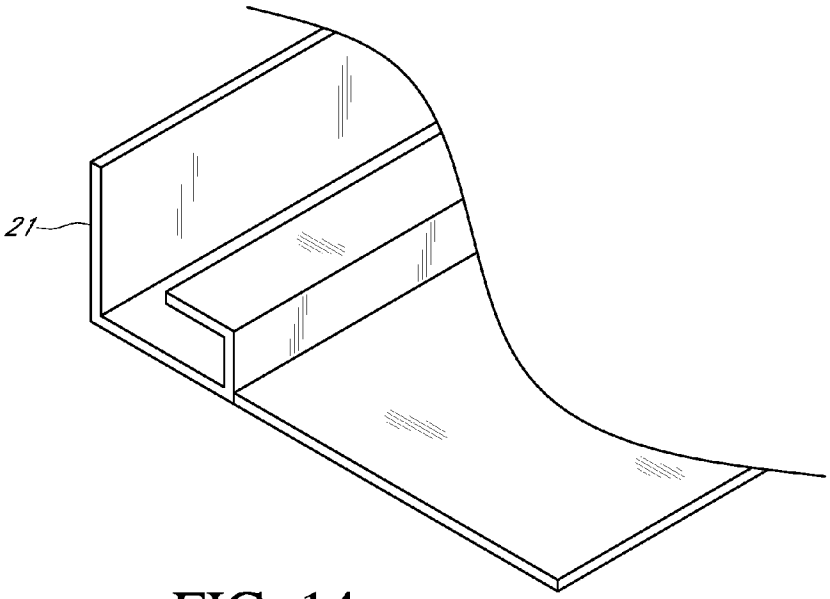
FIG. 14 is a perspective view of an embodiment of a ground rail having an extended base for use with soft material.
Figure 13:
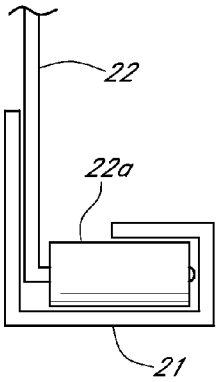
FIG. 13 is an end view of one embodiment of a vertical rail roller of a vertical rail section engaged with a ground rail.

Two embodiments of ground rails 21 are shown in FIGS. 13 and 14. The embodiment in FIG. 13 is shown engaged with a vertical rail roller 22*a*, which is described in detail below. The embodiment of a ground rail 21 shown in FIG. 14 includes an enlarged base section to reduce the pressure the ground rail 21 places on the area in which it is deployed. This embodiment of a ground rail may be especially useful when the ground rails 21 are placed adjacent a soft surface, such as snow or mud.

Figure 18:
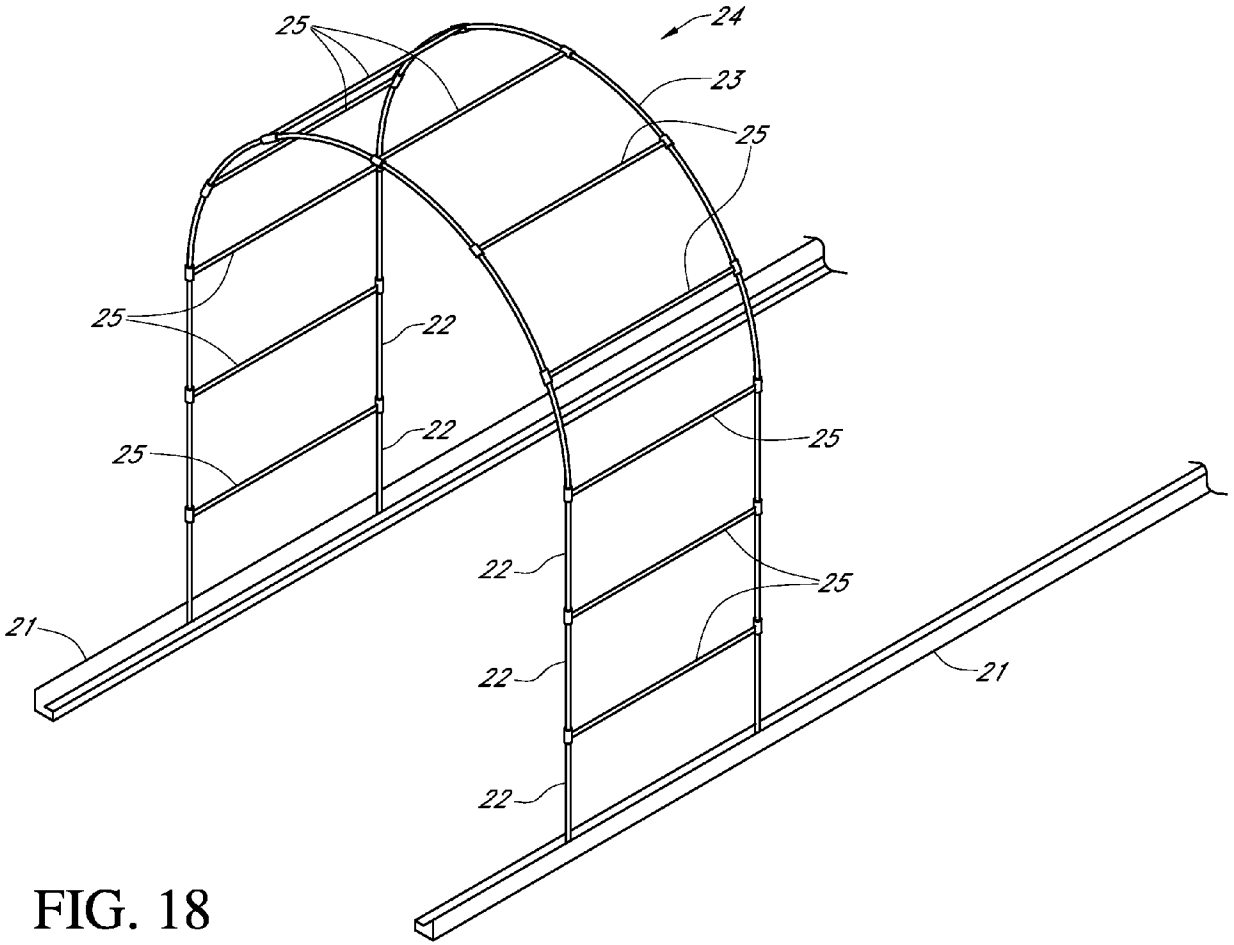
FIG. 18 provides a perspective view of two fully constructed uprights engaged with two ground rails and affixed to one another via a plurality of cross members.
Figure 19:
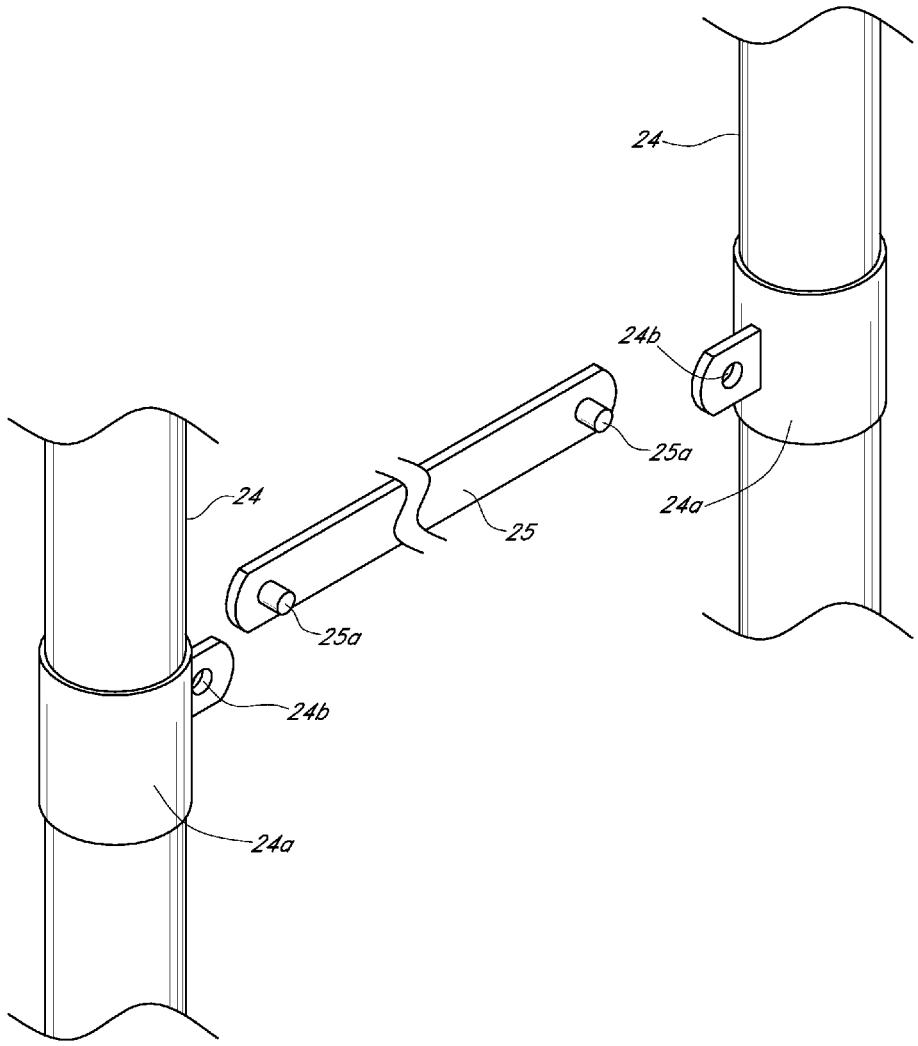
FIG. 19 is a detailed view of one embodiment for attaching the cross member to the upright.

After the ground rails 21 are placed, a laser level (not shown) and computer (not shown) may be used to determine the elevation at various points along the ground rails 21 that would yield a surface that is level and substantially the same elevation as the floor of the pod 12. Alternatively, the ground rail supports 21*a* may be adjusted such that each ground rail 21 is level and at a constant elevation with respect to a reference point on the pod 12. It is contemplated that such elevation will be slightly less than that of the floor of the pod 12. Once these values are determined, the first upright 24, which will be the upright 24 that is furthest from the pod 12, is constructed. The upright 24 generally forms a U-shape, as shown in FIG. 18. Together with the ground rails 21, the uprights 24 may comprise the suite frame 20. Two uprights 24 attached to one another through a plurality of cross members 25 are shown in FIG. 18. A more detailed view of how each cross member 25 may be affixed to a vertical rail section 22 is shown in FIG. 19. However, other connection structures and/or methods may be used other than those shown without departing from the spirit and scope of the portable structure 10.

Each upright 24 may be comprised of at least two vertical rail sections 22 having a vertical rail roller 22*a* at the lower end thereof. As shown in FIG. 13, the vertical rail roller 22*a* may engage the ground rail 21 in such a manner that once the upright 24 is constructed, it may be motivated along the ground rail 21 through the interface between the ground rail 21 and the vertical rail roller 22*a*. A number of vertical rail sections 22 make up each side of an upright 24, and each side may be connected to one another through an arch support 23, which forms the curved portion of the upright 24. The arch supports 23 may be flexible, rigid, or semi-rigid, depending on the specific application of the portable structure 10. In the event that the ground rails 21 are not first leveled, a computer (not shown) and laser level (not shown) may be used to measure and compute the quantity and length of vertical rail sections 22 to use for each upright 24 to ensure a level floor surface.

Figure 16:
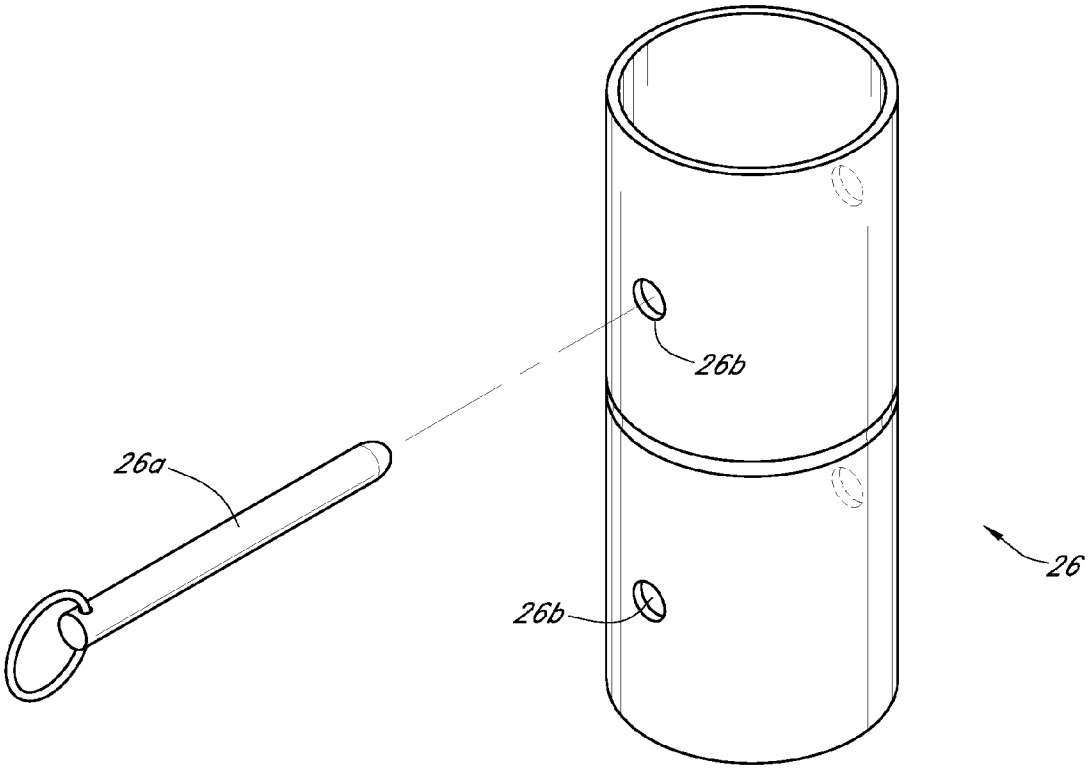
FIG. 16 provides a perspective view of one embodiment of a sleeve connector and a pin.
Figure 17B:
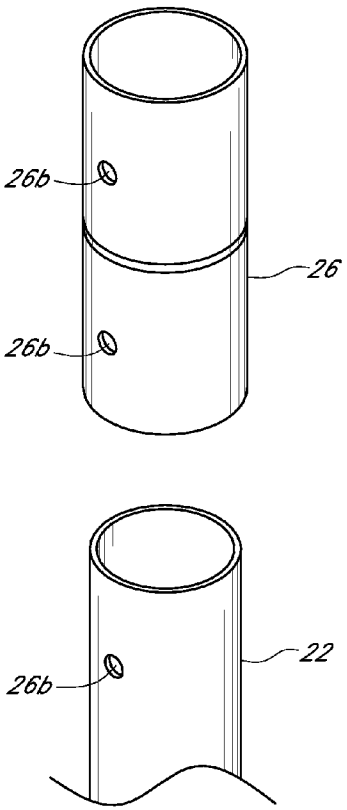
Figure 17A:
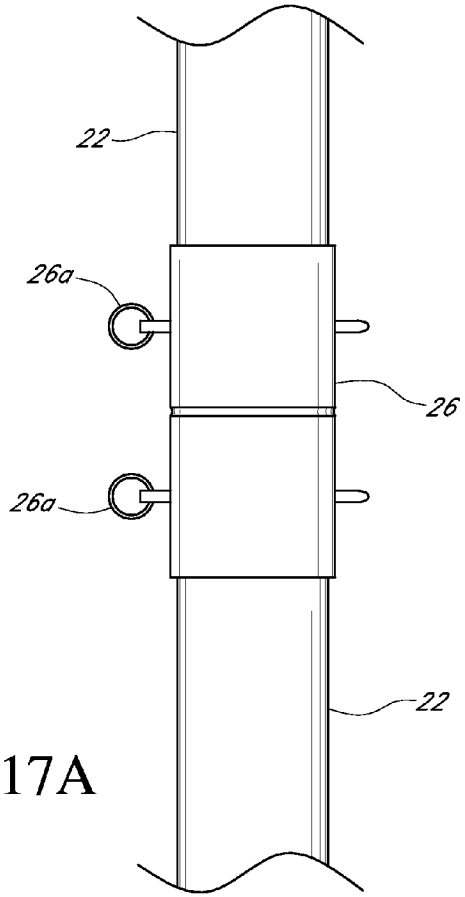
FIG. 17A provides a side view of a sleeve connector engaged with two vertical rail sections using two pins.

Adjacent vertical rail sections 22 of one upright 24 may be joined to one another through the sleeve connector 26 and a plurality of pins 26*a* in the first embodiment, which is best shown in FIGS. 16-17B. Two adjacent vertical rail sections 22 are shown engaged with one sleeve connector 26 in FIG. 17A, and one vertical rail section 22 positioned adjacent a sleeve connector 26 prior to insertion of a pin 26*a* is shown in FIG. 17B. A sleeve connector 26 may be placed over the adjacent ends of two vertical rail sections 22 on one side of an upright 24. Corresponding apertures 26*b* in the sleeve connector 26 (best shown in FIG. 16) and vertical rail sections 22 are oriented so that a first pin 26*a* may pass through the sleeve connector 26 and the top vertical rail section 22 and a second pin 26*a* may pass through the sleeve connector 26 and the bottom vertical rail section 22.

Because of the design of the vertical rail rollers 22*a* and the ground rails 21, during the construction of the suite frame 20 as each upright 24 is assembled according to the proper dimensions, that upright 24 is moved away from the pod 12 to make room adjacent the pod 12 for assembly of the next upright 24. Accordingly, the upright 24 furthest from the pod 12 is the first upright 24 assembled, and the upright 24 adjacent the pod 12 is the final upright 24 assembled.

The horizontal space between adjacent uprights 24 may vary from one embodiment of the portable structure 10 to the next and therefore in no way limits the scope of the portable structure 10. Each upright 24 may be separated from the next upright 24 by equal amounts throughout the entire suite frame 20, or the distances between adjacent uprights 24 may vary. The distance between adjacent uprights 24 is determined by the dimensions of the cross members 25 used, one embodiment of which is shown in detail in FIG. 19. This embodiment of cross members 25 uses tabs formed in the cross member 25 and corresponding fixtures 24*a* affixed to the upright 24 having fixture apertures 24*b* formed therein. As previously mentioned, FIG. 19 represents but one of an infinite number of ways that the cross members 25 may be secured to the uprights 24, and is therefore in no way limiting to the scope of the portable structure 10.

In one embodiment of the portable structure 10 each upright 24 will be separated from the next by six feet, and the position of each vertical rail roller 22*a* with respect to the ground rail 21 will be fixed by at least one set screw (not shown) for each vertical rail roller 22*a*. The first upright 24 that is constructed (i.e., the upright 24 furthest from the pod 12) may have mesh covering 38 and/or a cocoon section 40, described in detail below, over the end thereof to seal that end of the suite 30 from the environment. The last upright 24 that is constructed (i.e., the upright 24 closest to the pod 12) may have a special mesh covering 38 and/or cocoon section 40 that correspond with the pod 12 in such a manner as to create a smooth transition between the suite 30 and the pod 12, as well as ensuring that both the pod 12 and the suite 30 are sealed and protected from the external environment of the portable structure 10.

Figure 20:
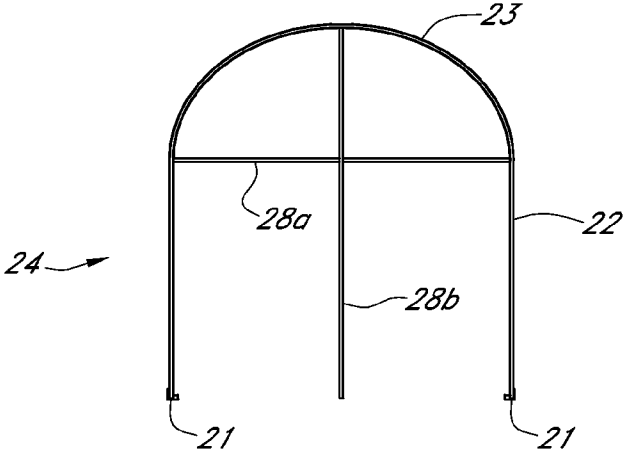
FIG. 20 is an end view of one embodiment of the suit frame having a plurality of horizontal and vertical cables.

In the embodiment shown in FIG. 20, a plurality of vertical cables 28*b* and horizontal cables 28*a* may be used to strengthen the suite frame 20. The precise position of each horizontal and vertical cable 28*a*, 28*b* may vary from one embodiment of the portable structure 10 to the next, and is therefore in no way limiting. Horizontal cables 28*a* connect each end of the arch support 23 in each upright 24 in the embodiment shown in FIG. 20. Additional horizontal cables 28*a* connect corresponding vertical rail sections 22 for added support. Vertical cables 28*b* may be affixed to the arch support 23 and extend to the floor level or beyond, depending on the specific application of the portable structure 10.

As will be apparent to those skilled in the art, a leveling operating floor in the suite frame 20 may be ensured through one of two methods. In the first method, the ground rails 21 are leveled with respect to the pod 12 by adjusting the height of the ground rail supports 21*a*. In the second method, the number of vertical rails sections 22 on any given upright 24 is adjusted to compensate for changes in terrain on which the ground rails 21 rest.

As each upright 24 is constructed a mesh covering 38 may be positioned over each upright 24. One embodiment of what the mesh covering 38 may comprise is shown in FIGS. 41A and 41B. The mesh covering 38 in FIG. 41A is shown in the shape of an upright 24, while the mesh covering 38 in FIG. 41B is shown in a planar orientation. The material from which the mesh covering 38 is constructed is preferably light weight, such as a plastic or polymer, but any material known to those skilled in the art may be used without limitation.

Figure 21:
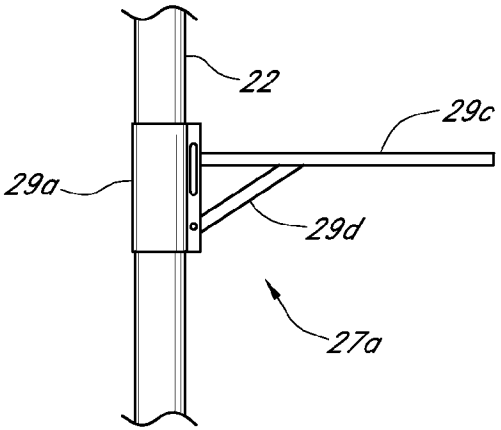
FIG. 21 is a side view of one embodiment of an outside floor support.

Outside floor supports 27*a*, one embodiment of which is shown engaged with a vertical rail 22 in FIG. 21, may be affixed to vertical rail sections 22 so that the outside floor support 27*a* extends inward from the vertical rail section 22. The position of the outside floor support 27*a* on the vertical rail section 22 may be determined by the laser level (not shown) and computer (not shown) to ensure that all outside floor supports 27*a* form a level plane. Each outside floor support 27*a* may include a floor support sleeve 29*a*, at least one floor support platform 29*c*, at least one floor support arm 29*d*, and at least one floor support clamp 29*b*.

Figure 23:
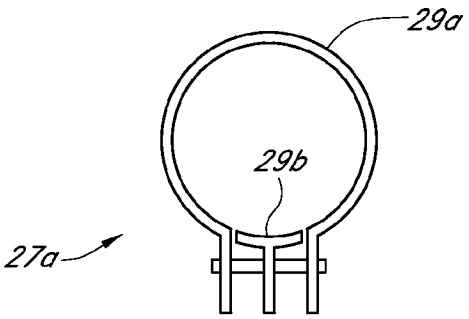
FIG. 23 is an end view of one embodiment of an outside floor support showing the floor support sleeve and clamp.
Figure 25:
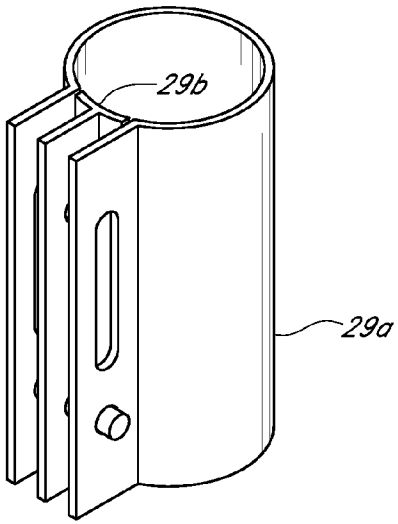
FIG. 25 is a perspective view of one embodiment of an outside floor support with the floor support sleeve and claim engaged with one another.
Figure 24:
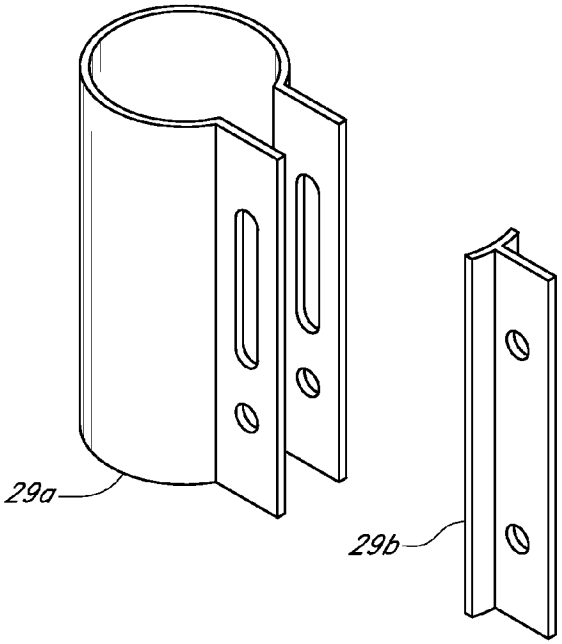
FIG. 24 is a perspective view of one embodiment of an outside floor support showing the floor support sleeve and clamp as removed from one another.
Figure 27:
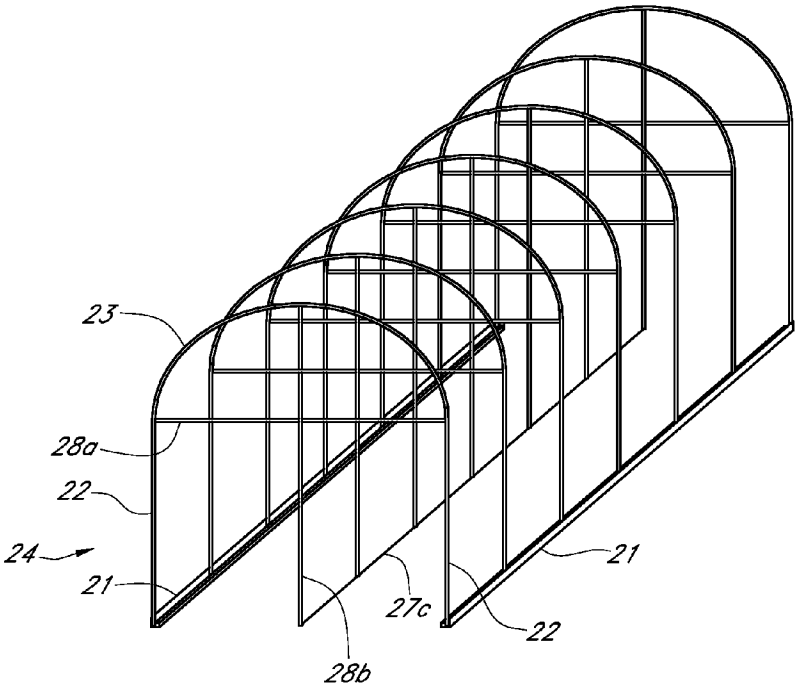
FIG. 27 is a perspective view of one embodiment of a suite frame having a center floor member affixed to the vertical cables 28*b*.

The floor support arm 29*d* may be rigidly affixed at one end thereof to the floor support platform 29*c* and rigidly affixed at the opposite end thereof to the floor support clamp 29*b*. The floor support clamp 29*b* may be pivotally engaged with the floor support sleeve 29*a*, as indicated by the arrangement shown in FIGS. 23 and 25. One embodiment of the floor support sleeve 29*a* and floor support clamp 29*b* are shown separated from one another for clarity in FIG. 24. Accordingly, the outside floor supports 27*a* may be configured so that as more force is placed downward onto the floor support platform 29*c*, the floor support clamp 29*b* is pressed against the vertical rail section 22 with increasing force. That is, as the floor support platform 29*c* experiences downward force, the floor support arm 29*d* experiences a downward force, which in turn causes the floor support clamp 29*b* to pivot inward toward the vertical rail section 22 with increasing force. Other embodiments for the outside floor supports 27*a* exist but are not pictured herein, and any structure known to those skilled in the art that will cause the floor support clamp 29*b* to place greater force on the vertical rail section 22 as more weight is placed on the floor support platform 29*c* may be used without limitation. Furthermore, any structure and/or method that will securely affix an outside floor support 27*a* to a vertical rail section 22 may be used with the portable structure 10 without limitation, including but not limited to set screws (not shown), welds, chemical adhesion, and/or combinations thereof.

Figure 22:
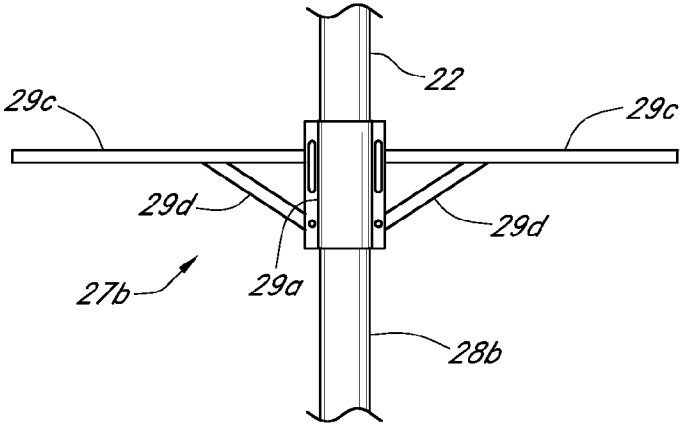
FIG. 22 is a side view of one embodiment of an inside floor support.

A side view of one embodiment of an inside floor support 27*b* is shown affixed to a vertical cable 28*b* in FIG. 22. The inside floor support 27*b* may be affixed to the vertical cable 28*b* in the same manner as the outside floor support 27*a* is affixed to a vertical rail section 22. However, in the embodiment pictured in FIG. 22 each inside floor support 27*b* includes two floor support platforms 29*c* and two floor support arms 29*d* extending from a common floor support sleeve 29*a* in opposite directions.

Figure 26:
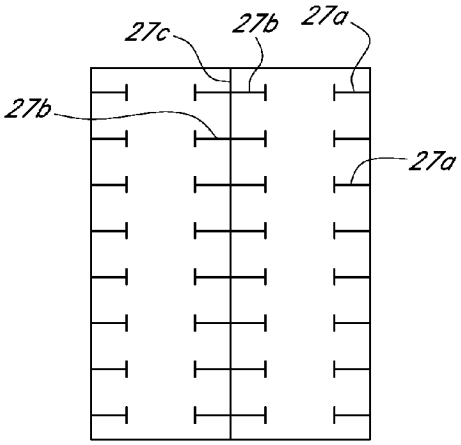
FIG. 26 is a top view of one embodiment of a floor grid showing outside and inside floor supports.

One embodiment of a floor grid comprised of a plurality of outside and inside floor supports 27*a*, 27*b* is shown from the top view in FIG. 26. The inside floor supports 27*b* may be affixed to the center floor member 27*c* in addition to a vertical cable 28*b* for additional strength. The center floor member may be formed as a rigid or semi-rigid rod (or tensioned cable) that extends the length of the suit frame 20 and is affixed at either end to the vertical cables 28*b* of the two terminal uprights 24. The outside floor supports 27*a* may be affixed to vertical rail sections 22. Adjacent outside or inside floor supports 27*a*, 27*b* within a given row may be connected to one another to provide additional strength to the floor grid through any structure and/or method suitable for the particular application, including but not limited to cables, plates, rods, and/or combinations thereof. After all the outside and inside floor supports 27*a*, 27*b* have been positioned and leveled with respect to one another, the floor sheet 48 may be extended onto the floor support platforms 29*c* of the outside and inside floor supports 27*a*, 27*b*. The floor sheet 48 may be configured as a singular unit or in several panels that may be affixed to one another. It is contemplated that the floor sheet 48 will be rigid or semi rigid depending on the spacing and side of the floor support platforms 29*c*. The specific area of the floor support platforms 29*c* may vary from one embodiment to the next, and the optimal dimensions vary depending on the orientation of the suite frame 20. However, it is contemplated that many applications will require floor support platforms 29*c* have an area between two square inches and five hundred square inches.

As mentioned, a floor grid layout may include center floor member 27*c* that may be affixed to the vertical cables 28*b* to provide more support for the floor sheet 48. Additional vertical cables 28*b* may be affixed to the arch support 23, and additional center floor members 27*c* may be affixed to those vertical cables 28*b* to increase the load-bearing capabilities of the floor. One embodiment of the suite frame 20 is shown in perspective in FIG. 25, wherein each arch support 23 includes one vertical cable 28*b* affixed thereto, and one horizontal cable 28*a* affixed thereto. The embodiment in FIG. 25 also includes a center floor member 27*c*. A horizontal cable 28*b* may also be affixed to corresponding vertical rail sections 22 on opposite sides of each upright 24 for additional support.

Figure 29:
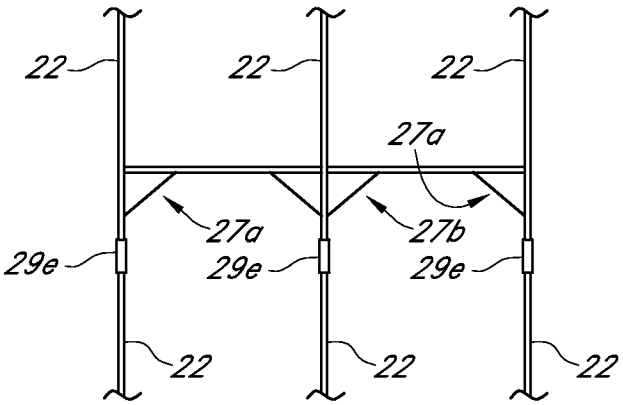
FIG. 29 is a side view of a plurality of equalizers installed between vertical rail sections adjacent inside and outside floor supports.
Figure 28:
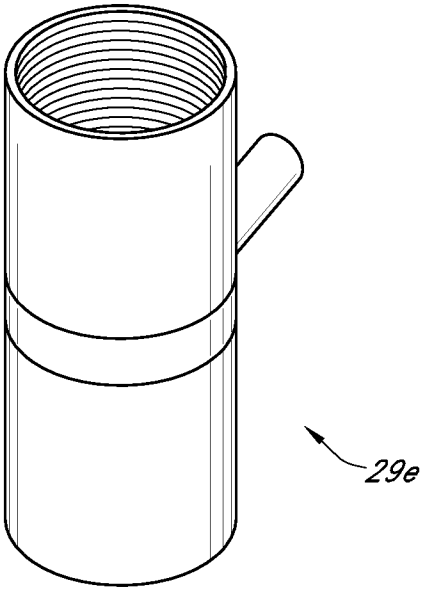
FIG. 28 is a perspective view of one embodiment of an equalizer that may be used to adjust the position of the floor supports.

To ensure that neither the outside and inside floor supports 27*a*, 27*b* slip downward as weight is placed upon the floor support platforms 29*c*, an equalizer 29*e* (one embodiment of which is shown in FIG. 28) may be positioned below each outside and inside floor support 27*a*, 27*b*. The equalizer 29*e* may be used in place of a sleeve connector 26 to connect two vertical rail sections 22 whose junction is located immediately below either an outside or inside floor support 27*a*, 27*b*, one such arrangement is shown in FIG. 29. The embodiment of an equalizer 29*e* shown in FIG. 28 is threaded at each end to accept a threaded end of a vertical rail section 22, and is configured with a movable sleeve on the outer portion. As the central portion of the equalizer 29*e* is rotated, the ends of the two vertical rail sections 22 engaged with the equalizer 29*e* will be moved closer or further from one another depending on the direction of rotation. This allows for precise adjustments in the leveling of the inside and outside floor supports 27*a*, 27*b* during settling of the portable structure 10. The equalizers 29*e* may be adjusted when the floor sheet 48 is extended or before the floor sheet 48 has been positioned on the floor support platforms 29*c*.

Figure 30:
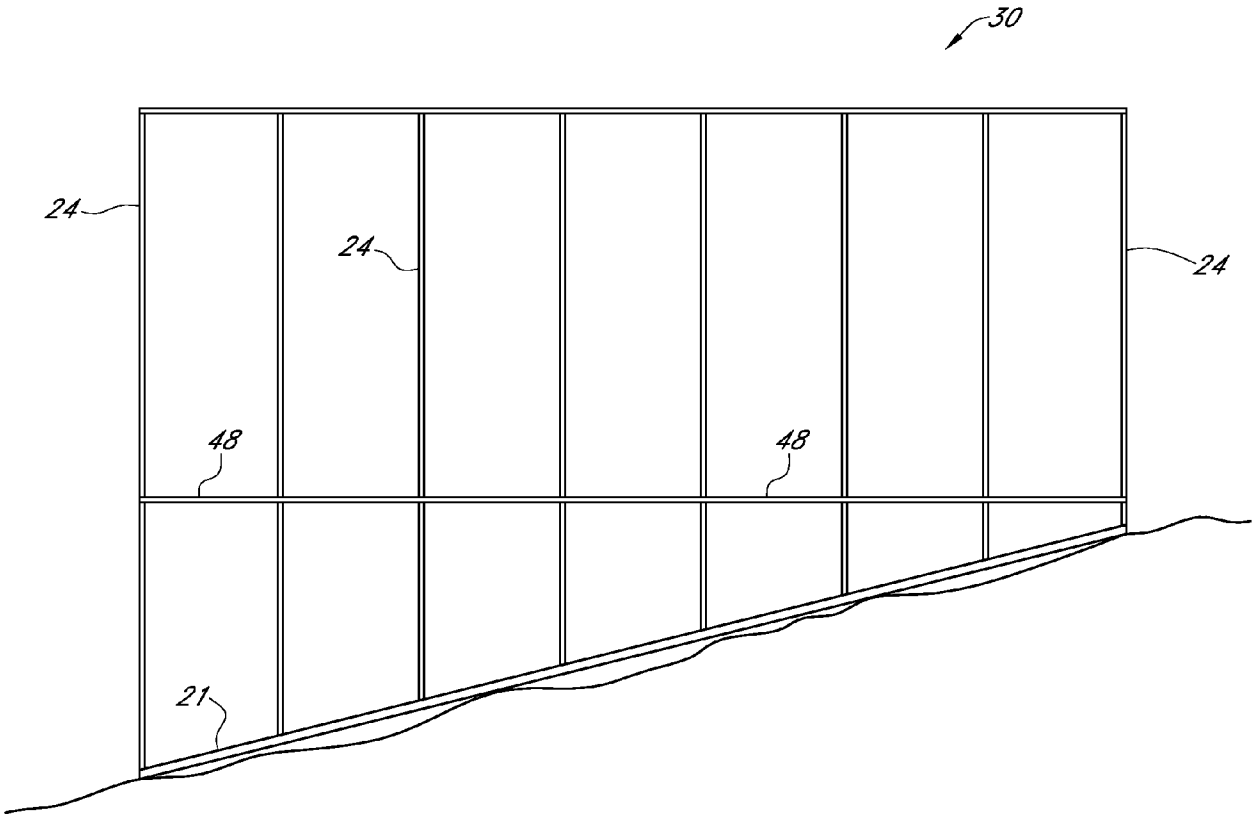
FIG. 30 is a side view of one embodiment of the suite frame erected on uneven terrain.

An illustrative embodiment of a suite frame 20 is shown constructed over an uneven surface in FIG. 30, and the suite frame 20 affixed to the pod 12 is shown in FIG. 31. As previously described, to account for the uneven terrain, the number of vertical rail sections 22 on each side of each upright 24 may be adjusted, or the ground rail supports 21*a* may be adjusted. As shown in FIG. 30, the uprights to the left of the figure have a greater number of vertical rail sections 22 on each side than those towards the right of the figure. The laser level (not shown) and computer (not shown) may be used to determine the number of vertical rail sections 22 needed to ensure the top of the suite frame 20 is substantially level. However, even if the suite frame 20 is not absolutely level, the equalizers 29*e* in cooperation with the outside and inside floor supports 27*a*, 27*b* allow the user to ensure that the floor sheet 48 may be adjusted for an absolutely level work surface. Each upright 24 may be separated from the next upright 24 by equal amounts throughout the entire suite frame 20, or the distances between adjacent uprights 24 may vary.

Figure 41:
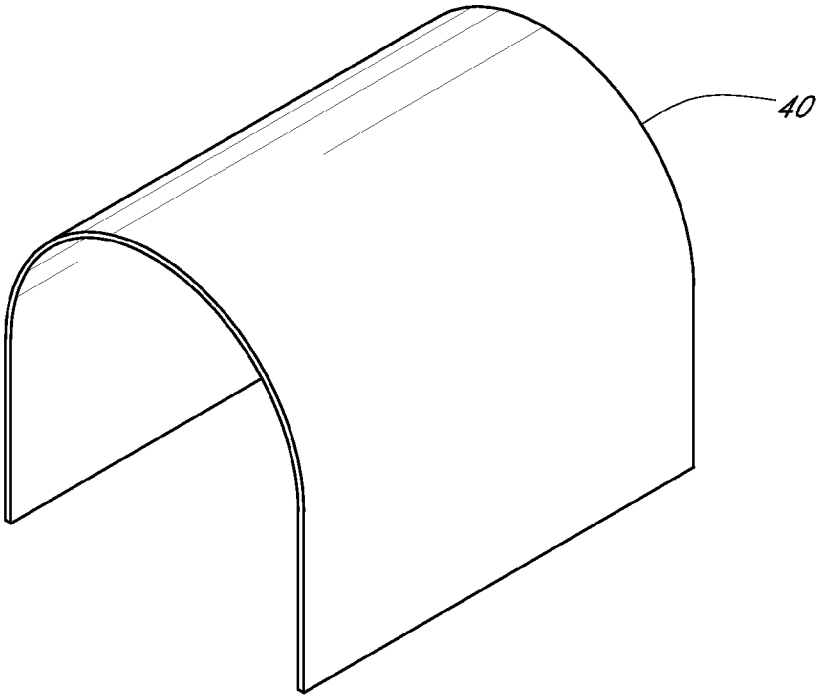
FIG. 41 is a perspective view of one embodiment of one section of the cocoon material that may be placed over the mesh covering.

After the suite frame 20 is fully assembled and leveled, and the floor sheet 48 has been extended on the floor support platforms 29*c*, a plurality of cocoon sections 40 may be positioned over the mesh covering 38 to protect the suite 30 from a variety of hazards. The cocoon sections are fully described in U.S. patent application Ser. No. 12/716,039, which is incorporated by reference herein in its entirety. Each cocoon section 40, one embodiment of which is shown in FIG. 41 may be made from a material or combination of materials that alone or in combination provide resistance to water, environmental pollutants, radiation, industrial pollutants, electromagnetic waves, and abrasion. Furthermore, each cocoon section 40 may be configured to provide heat and/or cooling to the suite 30 as needed, and each cocoon section 40 may be configured to absorb mechanical energy from the impact of various hazards such as ice, hail, failing rocks, and the like through the use of inflatable layers. Each cocoon section 40 is typically flexible and preformed so that each cocoon section 40 fits over a specific portion of the suite frame 20.

Figure 43:
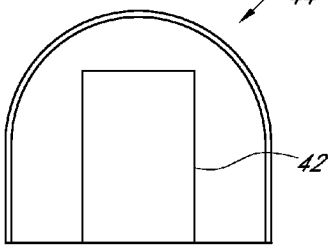
FIG. 43 is an end view of one embodiment of a suite access door and suite canopy.
Figure 42:
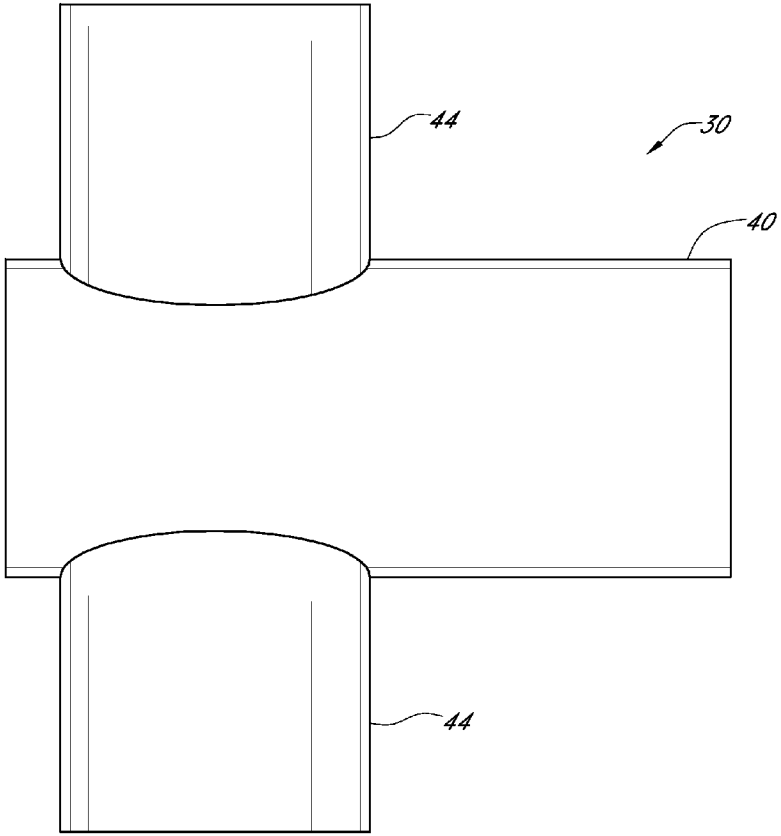
FIG. 42 is a top view of an embodiment of the suite having two access doors and two suite canopies.
Figure 45:
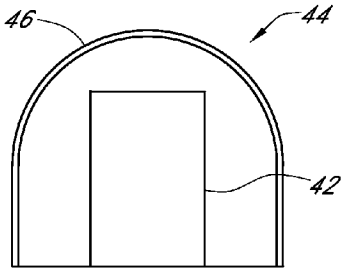
FIG. 45 is an end view of one embodiment of a suite access door and suite canopy.
Figure 44:
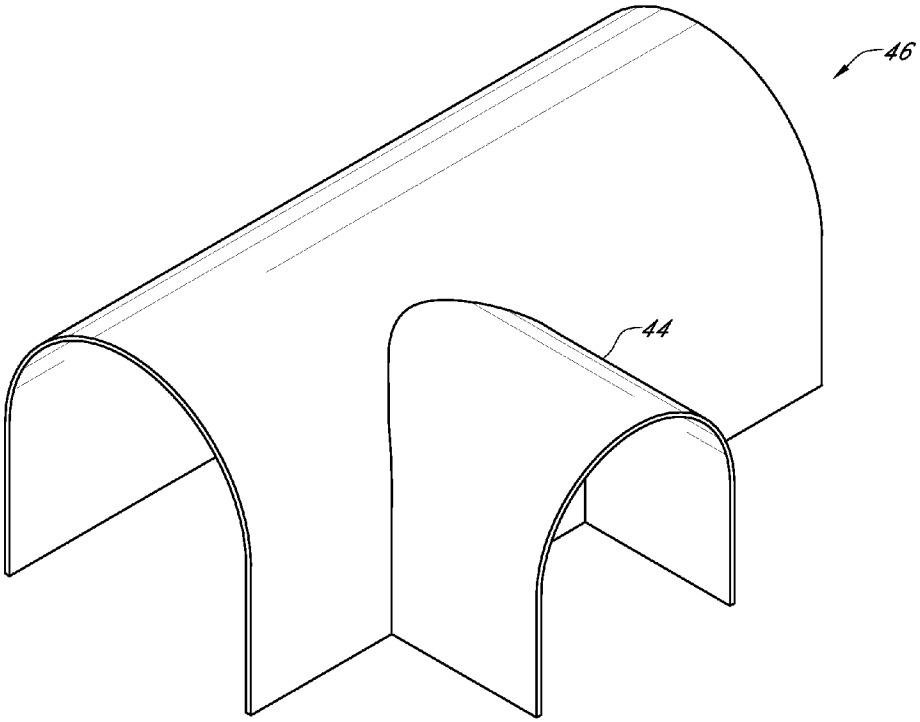
FIG. 44 is a perspective view of an embodiment of a cocoon canopy section.

One embodiment of the suite 30 is shown from above in FIG. 42 and in perspective in FIG. 44, wherein the suite 30 includes two suite canopies 44 on each side of the suite 30. Inside each suite canopy 44 a suite access door 42 may be positioned to provide access to the interior of the suite 30 from the surrounding environment. The suite access doors 42 may be sliding-type doors to conserve space and for less complexity, such as those shown in FIG. 43. A cocoon canopy section 46 is shown in FIG. 44. A suite canopy 44 may be integrated into an adjacent cocoon section 40. The suite canopy 44 and the suite access door 42 positioned therein is shown from the exterior thereof in FIG. 45. Although not shown, the end of the suite 30 furthest from the pod 12 may include a suite access door 42 and a ladder (not shown) to directly access the exterior terrain surface adjacent that end of the suite 30.

The portable structure 10 is shown with the suite 30 constructed and attached to the pod 12 in FIG. 31. As shown the portable structure 10 may be deployed on uneven terrain. The dimensions of the suite 30, suite frame 20, pod 12, and various elements thereof may be different than those indicated by the scale in FIG. 31, and are therefore in no way limiting to the scope of the portable structure 10. The surface of the floor sheet 48 may be coplanar and level with respect to the bottom surface of the pod 12 so that ingress/egress from one to the other is simple and efficient. It is contemplated that when the portable structure 10 is deployed on uneven terrain, the end of the pod 12 to which the suite 30 connects should be facing down slope, as is shown in FIG. 31. For additional strength exterior cables (not shown) may be anchored to the terrain at one end, draped over the exterior of each cocoon section 40, and subsequently anchored to the terrain at the opposite end of the exterior cable (not shown).

Figure 34A:
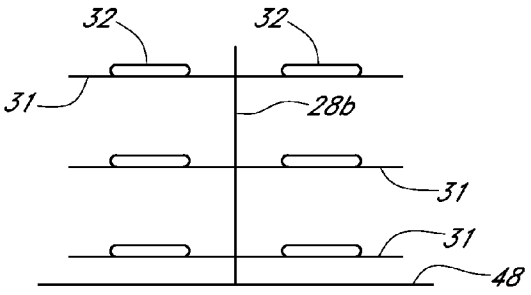
FIG. 34A is an end view of one embodiment of the suite showing one arrangement for treatment areas along the center vertical cables.
Figure 33:
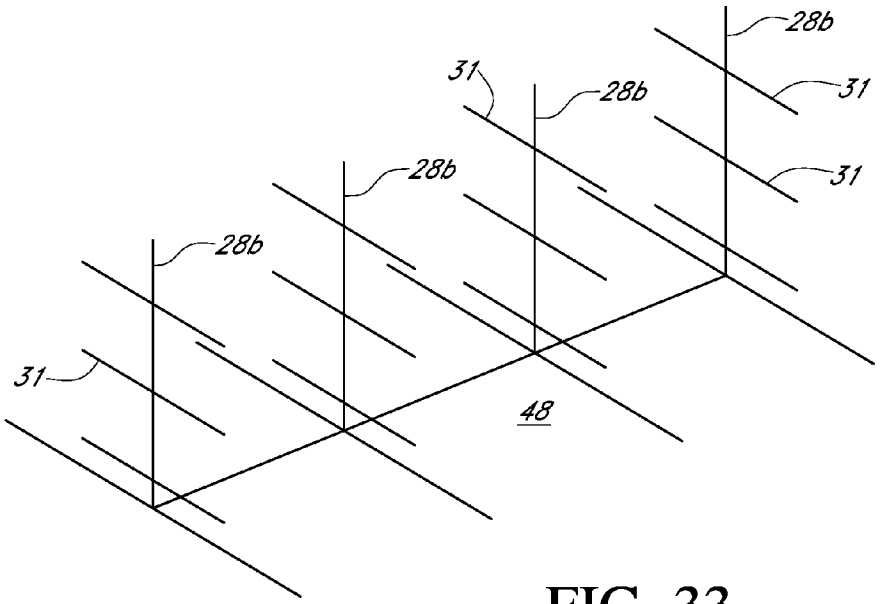
FIG. 33 is a perspective view of one embodiment of the vertical cable and treatment area supports.
Figure 34B:
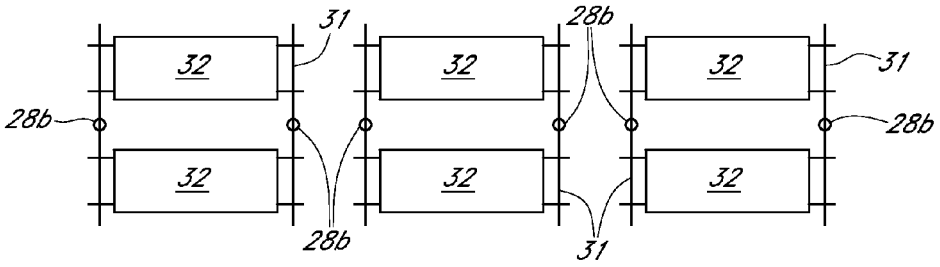
FIG. 34B is a top view of one embodiment of the suite showing one arrangement for treatment areas along the center vertical cables.
Figure 34C:
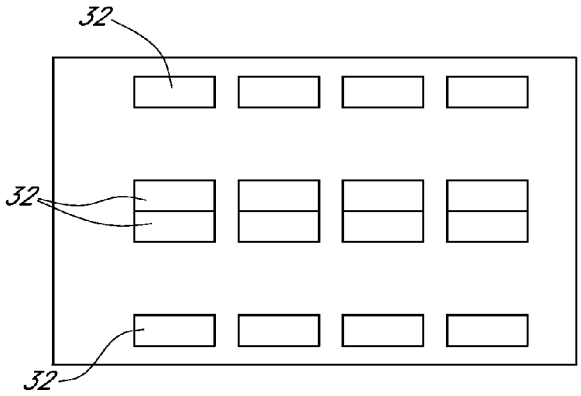
FIG. 34C is a top view of one embodiment of the floor plan of the suite showing one arrangement for treatment areas within the suite.

Once the portable structure 10 is fully deployed and assembled, the interior layout may be arranged for an infinite number of situations. The optimal arrangement will depend on the purpose for which the portable structure 10 is deployed. One possible arrangement for the interior of the suite 30 is shown in FIGS. 34A-34C. In this arrangement the interior of the suite 30 is arranged with a plurality of bunks forming different treatment areas 32. Each treatment area 32 may be suspended from the floor sheet 48 using a plurality of treatment area supports 31, which may be affixed to vertical cables 28*b* as shown in FIG. 33. Treatment area supports 31 may be configured as any rigid or semi rigid member that will bear the weight of an average human plus a nominal amount for clothing, equipment, and the like. The treatment area supports 31 may be attached to the vertical cables 28*b* using any structure and/or method known to those skilled in the art, including but not limited to clamps, rivets, chemical adhesion, and/or combinations thereof. Additional vertical cables 28*b* may be used to connect adjacent treatment area supports 31 to one another, as may angled cables (not shown) affixed to a vertical cable 28*b* at one end and to either end of the treatment area support 31 at the opposite end.

An end view of one section of treatment areas 32 is shown in FIG. 34A, from which it is clear that the first embodiment allows the treatment areas 32 to be positioned above and below one another. A top view of the center section of treatment areas 32 is shown in FIG. 34B, which shows that the vertical cables 28*b* along the center of the suite frame 20 may have treatment areas 32 on either side thereof. One row of treatment areas 32 may be positioned along each side of the uprights 24, as shown schematically in FIG. 34C. The optimal treatment area 32 structure will vary from one embodiment to the next, but it is contemplated that most applications will require a lightweight, rigid or semi-rigid surface approximately six feet long and at least two feet wide. Alternatively, the treatment areas 32 may be configured as cots, wherein two rigid members connected by a patient support unrolled so that the two rigid members rest upon two treatment area supports 31. More treatment areas 32 may be added in the same amount of space if the treatment areas 32 are smaller, and therefore the size of the treatment area 32 is in no way limiting to the scope of the portable unit 10. A number of sections of treatment areas 32 is shown from above in FIG. 35C.

Figure 35:
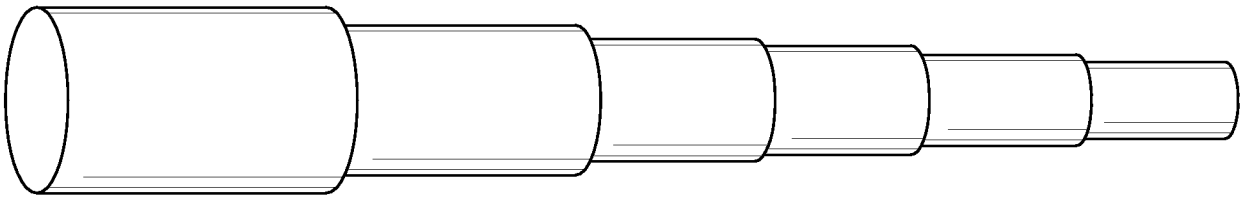
FIG. 35 is a side view of one embodiment of HVAC ductwork that may be used within the suite.
Figure 36:
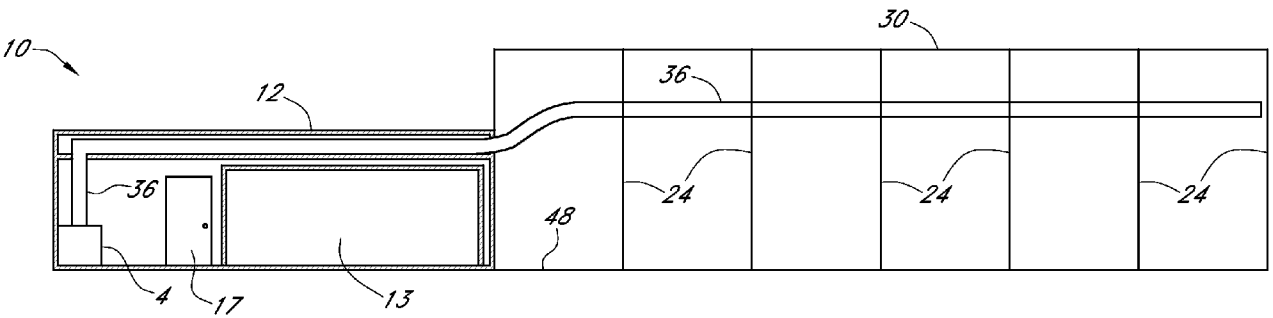
FIG. 36 is a side view of one embodiment of the arrangement of HVAC ductwork within the portable unit.
Figure 37:
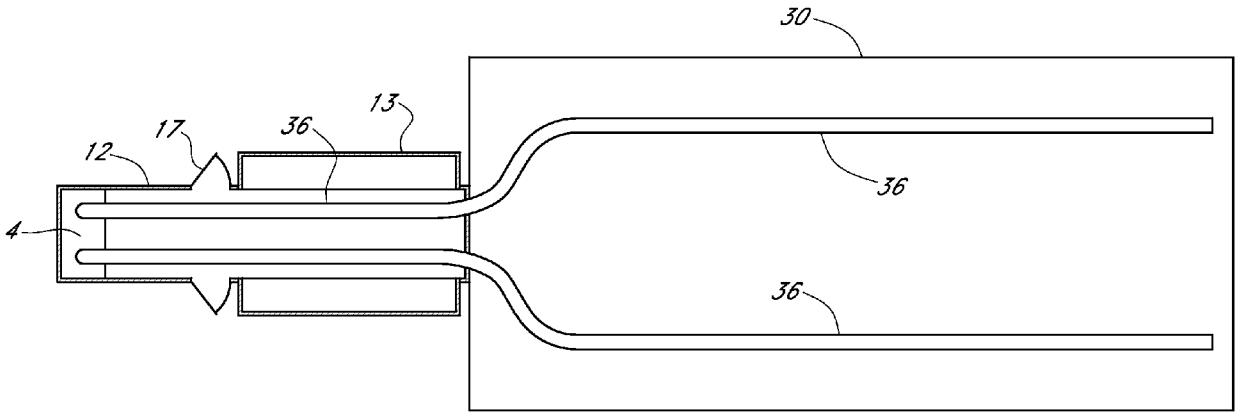
FIG. 37 is a top view of one embodiment of the arrangement of HVAC ductwork within the portable unit.
Figure 38:
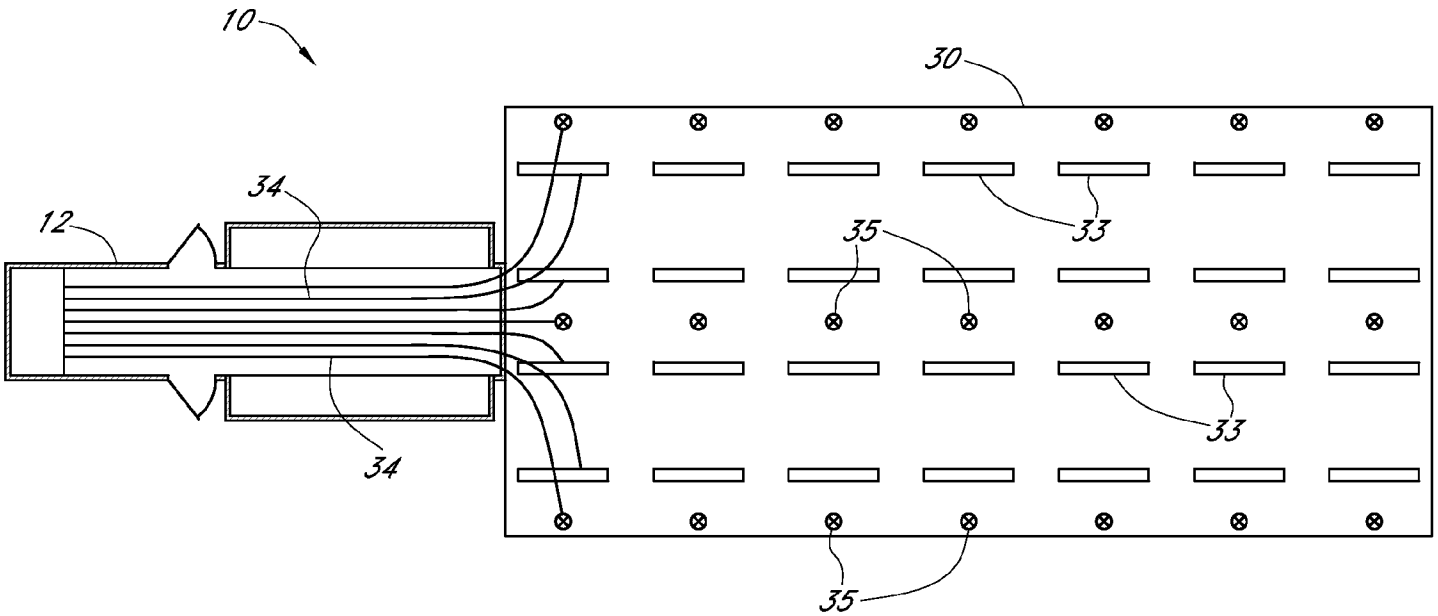
FIG. 38 is a top view of one embodiment of the arrangement of the lighting fixtures within the suite.

The interior of the suite 30 may be an entirely climate-controlled, protected area that is impervious to the elements and other hazards as listed above. An HVAC 4, which may be placed in the pod 12, may be in fluid communication with the suite 30 through HVAC ductwork 36. As shown in FIG. 35, in one embodiment the HVAC ductwork 36 increases in cross-sectional area from one end to the next such that the HVAC ductwork 36 may telescope. A side view of one embodiment of HVAC ductwork 36 connecting the HVAC 4 in the pod 12 to the interior of the suite 30 is shown in FIG. 36, with FIG. 37 providing a top view thereof. As shown, two parallel runs of HVAC ductwork 36 may span the length of the suite 30 with various outlets (not shown) at certain portions to deliver conditioned air (either heated or cooled, which also may be humidified or dehumidified) to the interior of the suite 30. The exact arrangement of the HVAC ductwork 36 will vary depending on the dimensions of the portable structure 10 and the size of the HVAC 4, and is therefore in no way limiting in scope.

Figure 39:
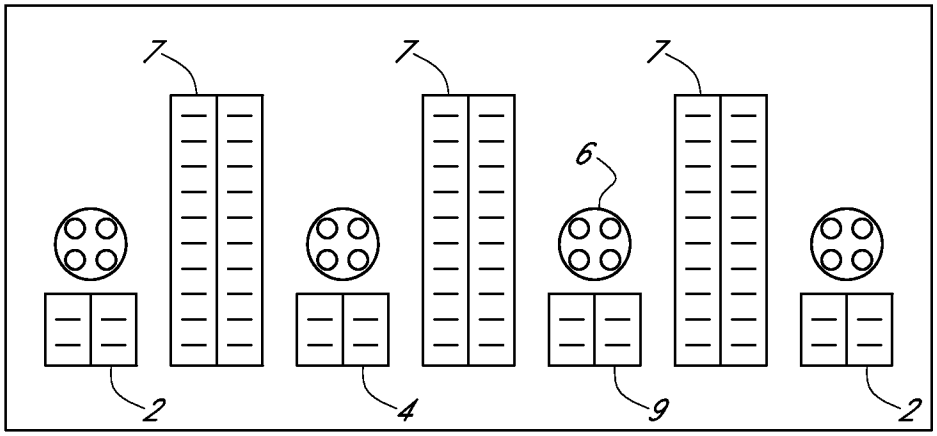
FIG. 39 is a side view of one embodiment of the arrangement of the various control centers, control panel, and generators for the portable unit.
Figure 40B:
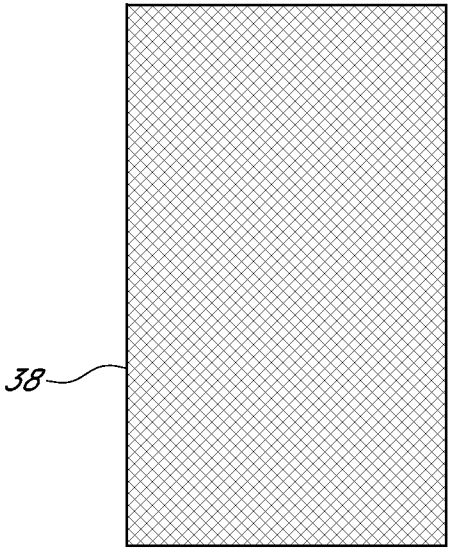
FIG. 40B is a top view of the mesh covering that may be placed over the suite frame in certain embodiments.
Figure 40A:
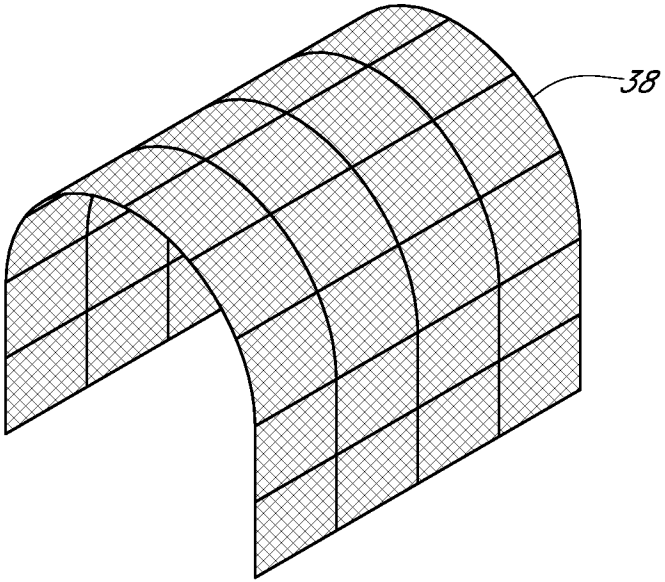
FIG. 40A is a perspective view of the mesh covering that may be placed over the suite frame in certain embodiments.

The interior of the suite 30 may also be illuminated by artificial light sources 33. One arrangement of artificial light sources 33 for the interior of the suite 30 is shown in FIG. 39, which also shows one arrangement for electrical outlets 35 and electrical conduit 34 connecting the light sources 33 and/or electrical outlets 35 with the generator 2 in the pod 12. The light sources 33 and the electrical outlets 35 may hang from cables (not shown) attached to the uprights 24. It is contemplated that having light sources 33 and/or electrical outlets 35 near each treatment area 32 will be most desirable, and therefore the arrangement of light sources 33 and/or electrical outlets 35 will vary for each embodiment of the portable structure 10 and is in no way limiting to its scope. It is also contemplated that in many embodiments it will be beneficial for the portable structure 10 to include exterior lights, which are not shown herein for purposes of clarity.

Figure 32:
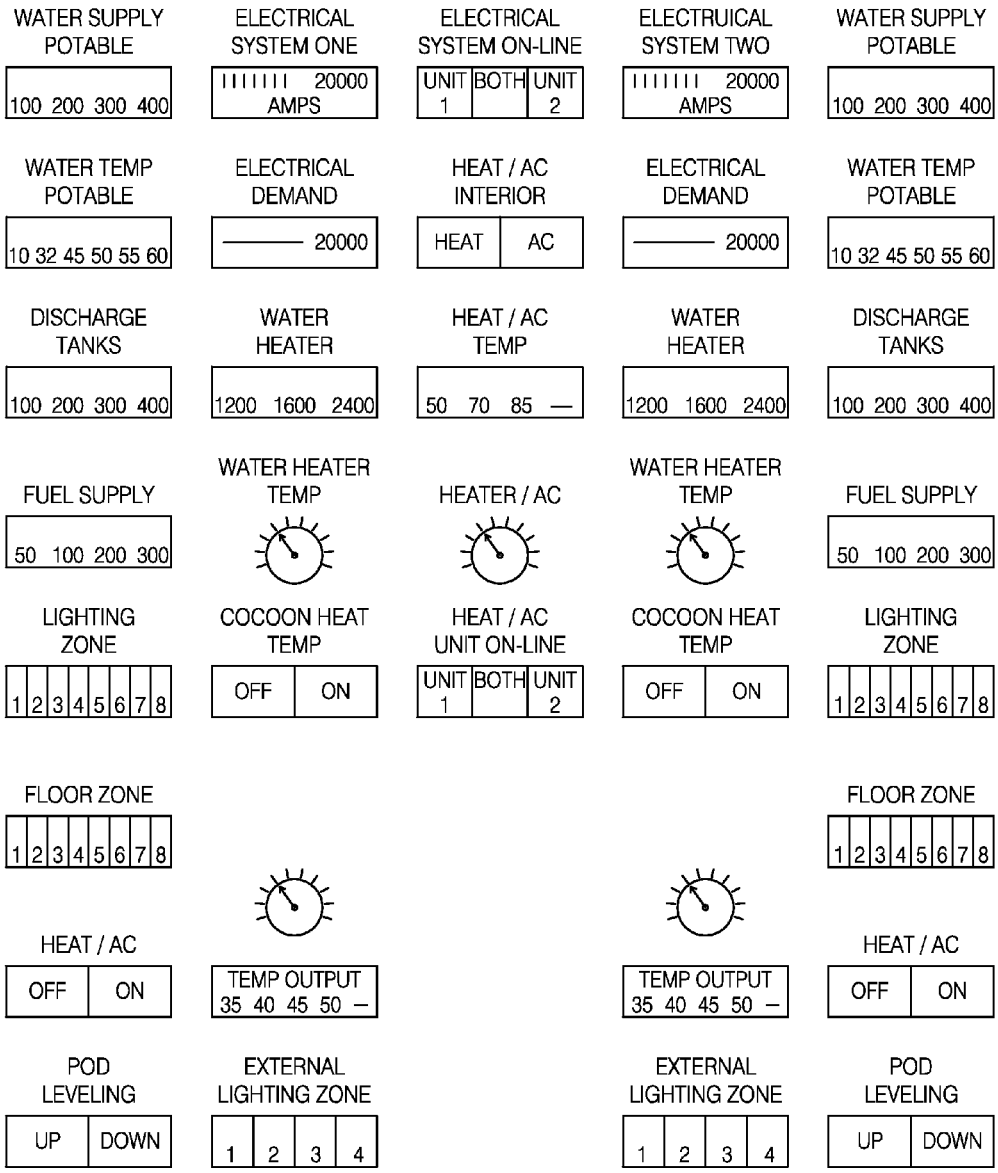
FIG. 32 is a simplified depiction of one embodiment for the control panel for the portable structure.

One arrangement of a control center, which may be used to monitor and control various systems and/or conditions relevant to the portable structure 10, is shown in FIG. 39. As shown, the arrangement in FIG. 39 may be positioned within the pod 12 at the end of the pod 12 furthest from the suite 30. Because the portable structure 10 may include electrical outlets 35, generators 2, HVAC 4, potable water, light sources 33, a conditioned air supply, and multiple treatment areas 32, the various systems of the portable structure 10 must be monitored and controlled. Accordingly, it is contemplated that at least one control panel 6 and breaker panel 7 will be required. Furthermore, at least one water control center 9 will be required for any portable structure 10 that includes a water system, such as the embodiments pictured herein. Multiple parameters internal and external to the portable structure 10 may be monitored and controlled, which parameters include but are not limited to, multiple potable water supply systems and quantities, multiple electrical system loading, electrical system switches, potable water system temperatures, electrical draw on multiple electrical systems, air temperature and humidity internal and external to the portable structure 10, fuel supply, generator load and temperature, level of pod 12, level of floor sheet 48, temperature of cocoon sections 40, cocoon heat, light level, air thermostat, external light level, level of suite frame 20, and waste tank level. One layout of certain parameters that may be monitored is shown in FIG. 32.

The optimal dimensions and/or configuration of the pod 12, suite frame 20, suite 30, and/or cocoon sections 40 will vary from one embodiment of the portable structure 10 to the next, and are therefore in no way limiting to the scope thereof. The various elements of the portable structure 10 may be formed of any material that is suitable for the application for which the portable structure 10 is used. Such materials include but are not limited to metals and their metal alloys, polymeric materials, cellulosic materials, and/or combinations thereof. Furthermore, the scope of the portable structure 10 is in no way limited by the specific shape and/or dimensions of the pod 12, suite frame 20, suite 30, and/or cocoon sections 40 or the relative quantities and/or positions thereof.

Having described the preferred embodiment, other features, advantages, and/or efficiencies of the portable structure 10 will undoubtedly occur to those versed in the art, as will numerous modifications and alterations of the disclosed embodiments and methods, all of which may be achieved without departing from the spirit and scope of the portable structure 10 as disclosed and claimed herein. It should be noted that the portable structure 10 is not limited to the specific embodiments pictured and described herein, but are intended to apply to all similar apparatuses for providing services and/or shelter in an expedient manner. Modifications and alterations from the described embodiments will occur to those skilled in the art without departure from the spirit and scope of portable structure 10.

2. General Description and Method of Use

A general description of the several elements of the portable structure 10 and how those elements may be assembled will now be described. However, the following description and method of construction is merely illustrative, and therefore will be different from one embodiment of the portable structure 10 to the next. Accordingly, the precise steps within the method of construction and various embodiments of the portable structure 10 are not meant to be limiting with respect to the scope of the claims herein.

First, the pod 12 of the portable structure 10 is positioned so the large back access door (not shown, but on the end of the pod 12 that is adjacent the suite 30 when fully deployed) faces down slope, after which the user may enter the pod 12 via a pod access door 17 and start the generator(s) 2. If a night operation, the user may also turn on interior lighting (not shown) and deploy the outside flood light system (not shown). The user then activates the pod leveling screws 14, which may be controlled by a laser level (not shown), computer (not shown), and rotational power source (not shown) so the pod 12 is level. The leveling screws 14 may also be adjusted manually. Contained within the pod 12 may be all the elements to construct the suite 30.

An access panel storage area (not shown, but which may be positioned above or below the large back access door) houses the strong and lightweight, specially designed ground rails 21 and other lower-section elements of the suite frame 20. The user then opens the access panel and removes the ground rails 21 and assembles them on the ground, whether the ground is even or uneven, in the configuration desired. The user then anchors the ground rails 21 to the ground utilizing the specially designed anchor rods (not shown) and anchors or the ground rail supports 21*a* so that their position is fixed.

A second access panel storage area (not shown) houses the strong and lightweight vertical rail sections 22 and cables that will be used to erect each upright 24 that will engage the ground rails 21. This access panel may be positioned adjacent the catwalk 19. Alternatively, one large access panel storage area may be used to hold all elements used to construct the suite frame 20. Accordingly, as long as the pod 12 includes storage areas of sufficient size to hold all elements of the suite frame 20, the storage areas may be configured in any manner without limitation.

Once the ground rails 21 are in place, and before any uprights 24 are assembled, the following is initiated: (1) a lap top computer (not shown) connected to a plug-in laser level measuring instrument (not shown) are both activated; (2) the laser level measuring instrument (not shown) is used in conjunction with the laptop computer to establish and save the "level" elevations for the suite frame 20; (3) the specially designed software will calculate the combination of various color coded components, locations, and elevations necessary for each upright 24, and the number of vertical rail sections 22 needed, once in the final position, so that the suite frame 20 will be level. A different method may be used if the ground rail supports 21*a* are used to level the ground rails 21.

Throughout the deployment and construction of the portable unit 10, the personnel may receive guidance from the laptop, which may also provide instructions as to the correct manner in the deployment and assembly of the suite 30 and suite frame 20.

Using the ladder 19*a*, the user climbs on top of the pod 12 and opens the access door (not shown) and then expands the catwalk 19. Next, the specially designed strong and light weight vertical rail sections 22 may be removed along with the specially designed arch supports 23, cross members 25, center floor members 27*c*, outside and inside floor supports 27*a*, 27*b*, and cables 28*a*, 28*b*. The vertical rail sections 22 having the specially designed vertical rail rollers 22*a* may be positioned adjacent the ground rails 21. The specially designed cocoon sections 40 and mesh covering 38 that will add rigidity to the structure may be removed from the pod 12.

The various elements then may be assembled per instruction. First, two vertical rail rollers 22*a* are affixed to two vertical rail sections 22 unless such vertical rail sections 22 have already been outfitted with vertical rail rollers 22*a*. Next, two outside floor supports 27*a* are placed on the two vertical rail sections 22. Additional vertical rail sections 22 are then connected on each side of the upright 24 using sleeve connectors 26 and pins 26*a* or an equalizer 29*e*.

Once each side of the upright 24 is constructed to the specified height (as determined by the computer), the arch support 23 is connected to both sides. Next, a horizontal cable 28*a* and corresponding cable brackets (not shown) are installed at each end of the arch support 23. A vertical cable 28*b* and corresponding cable bracket (not shown) is placed at the top of the arch support 23. The next upright 24 is assembled in the same manner, and after two uprights 24 have been assembled, they are affixed to one another with cross members 25. Also, a portion of the mesh covering 38 may be placed over the furthest upright 24. With the exception of the outside and inside floor supports 27*a*, 27*b*, ground rails 21, vertical rail rollers 22*a*, and other elements located below the floor sheet 48, the assembly work is done from on top of the pod 12.

As each upright 24 is assembled, the bottom vertical rail section 22 having the vertical rail roller 22*a* attached thereto rests in/on the respective ground rail 21. As each new upright 24 is erected, it is attached to the last upright 24 assembled via a plurality of cross members 25 and it, with the previous uprights 24, rolls down the ground rails 21 away from the pod 12. Once each new upright 24 is erected, a mesh covering 38 and a cocoon section 40 may be secured to that specific upright 24.

Once the cocoon sections 40 and/or mesh covering 38 is secured to the upright 24, that upright 24 is moved forward away from the pod 12, utilizing a winch system (not shown), on the ground rails 21. The process continues on the next upright 24 and until the entire suite frame 20, mesh covering 38, and cocoon sections 40 are assembled and erected.

The first upright 24 will also have an "end section" installed. A specially designed guidance system advances the completed uprights in a precise manner along the entire length of the ground rails 21. Once the suite frame 20 is assembled and erected and is secured to the ground rails 21, the inner floor elements may be installed.

The first step in installing the floor is to laser the correct elevations for a level floor. This ensures that the elevation of the floor is level no matter what the topography on which the portable structure 10 rests. The pod 12 may be anchored to the uneven ground, and slopping down, but because the floor elevation is laser leveled, the interior floor of both the suite 30 and the pod 12 are level.

Once the laser level has established the proper floor elevation with respect to each vertical rail section 22, the user may then position and secure the specially designed outside floor supports 27*a* on the vertical rail sections 22. Next the user may laser the elevation of the specially designed inside floor supports 27*b* and center floor member 27*c* with respect to the vertical cables 28*b*. Then the inside floor supports 27*b* and center floor member 27*c* may be secured in position on each vertical cable 28*b*. After the outside and inside floor supports 27*a*, 27*b* have been leveled and secured, the floor sheet 48 is extended and rests upon the floor support platforms 29*c* of the outside and inside floor supports 27*a*, 27*b*. If the floor sheet 48 is modular, a specially designed tape may be used to cover all the joints, cracks, and seams to ensure a closed environment.

At this point, the cocoon sections 40 may be activated to provide the necessary protection to ensure a hermetically safe environment within the suite 30. The suite 30 and pod 12 now function as a portable structure 10 that is able to be erected on an uneven surface and have a hermetically sealed environment with a level and flat floor on which to conduct emergency operations. With the portable structure 10 complete and sealed, the HVAC 4, lighting systems, treatment areas 32, and electrical systems are rapidly deployed and the portable structure 10 is up and running.

The portable structure 10 may consist of the following the items listed below, which are approximate in size and scope, pending the engineering design and the desired size and scope required for the specific application.

A pod 12 of approximately thirty six feet in length may contain at least the following: a working area adjacent the end of the pod 12 that will be connected to the suite 30; catwalk 19 and ladder 19*a*; uprights 24 and the elements required to assemble them; cocoon sections 40; mesh covering 38; ground rails 21; floor sheet 48; HVAC 2; generators 2; breaker panels 7; water control center 9; HVAC ductwork 36; light fixtures 37; electrical conduit 34; and electrical outlets 35. When assembled the portable structure 10 will offer the insulated, hermitically controlled environment, for all circumstances, i.e., air-conditioned or heated, lighted, and sheltered from all the elements including the sun, rain, wind, snow, and/or ice.

Each cocoon section 40 is constructed of material that is incredibly strong, insulated, and durable. Each cocoon section 40 may be made of a plurality of modular units of approximately 20 feet in length and may be erected in sections. When the cocoon sections 40 are attached to one another they may be deployed over a suite frame 20 of twenty feet, forty feet, sixty feet, or any other length desired to accommodate the disaster or other need. Cocoon sections 40 may be fabricated to other lengths as well, and the specific length thereof is in therefore no way limiting.

The portable structure 10 may be erected large enough to accommodate forty people, sixty people, or more as the design specification require. The portable structure 10 may be fully functional and able to accept response teams, people or patients in a matter of ninety minutes or less, depending on the size of the portable structure.

Each portable structure 10 will be specifically outfitted to accommodate the specific mission of various agencies. For certain applications, some items may remain in the pod 12 throughout construction of the suite 30 and while the portable structure 10 is in use. For example, if the portable structure 10 is used as a triage facility, the following list is an example of some items that may remain inside the pod 12: a control center that monitors lighting, heating, cooling, water supply levels, discharge water levels, etc.; at least one generator 2 sized to provide all the electric needs; an HVAC with the associated controls; a reservoir providing potable water supply; a reservoir to collect discharge/waste water; pharmaceutical supplies and first aid supplies; a refrigerated chest for accommodating IV fluids; cabinets for other medical supplies; cabinet for uniforms, clothing, masks, gloves, etc.; sink and drains for washing purposes; a chemical toilet; a shower facility; hazardous waste receptacles; sharps and needle receptacles; sleeping and resting area, and any other supplies suitable for the particular application for which the portable structure is designed.

Other items that may be placed within the portable structure 10 that will be utilized in the portable structure 10 once erected include but are not limited to: a triage stretcher and sled; lighting units to illuminate the suite 30; HVAC ductwork 36; electrical outlets 35; waste containers; IV poles and other necessary equipment for the specific application of the portable structure 10.

Figure 11:
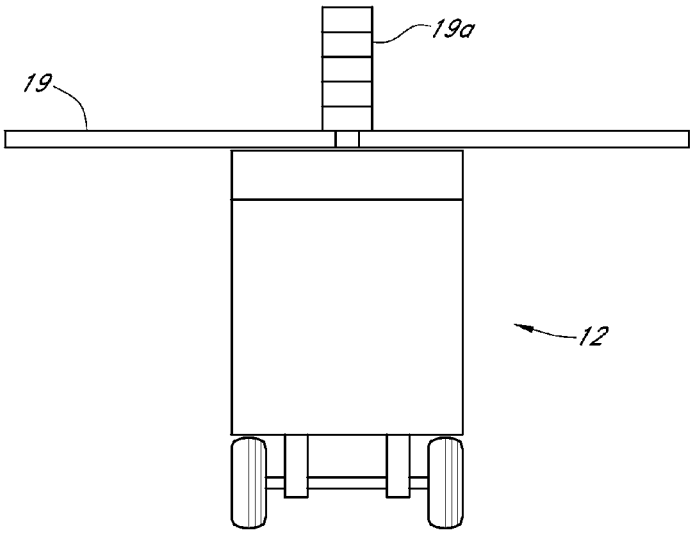
FIG. 11 provides an end view of the pod with the catwalk extended.

The pod 12 may also have suitable apparatus and hooks (not shown) allowing the pod 12 to be air lifted to inaccessible disaster areas via helicopter. In another embodiment, the pod 12 is outfitted with a retractable axle and wheel assembly to transport the pod 12 via roadways as indicated in FIG. 11.

The portable structure 10 affords emergency response personnel the ability to respond rapidly to any area, under any circumstances, day or night, winter or summer, heat, rain, snow or ice, and in a matter of minutes. Utilizing the portable structure 10 will provide a new dimension to the quality of care and the time-critical activity that is necessary to address the immediate threat or to treat and save lives on-site before transporting to another area. One of the most important features of the portable structure 10 is the ability to be utilized for an indefinite period of time in multiple scenarios. It may be used repeatedly for many years with the same assurance in quality response to any scenario.

All dimensions shown, described, indicated, or otherwise presented herein are for illustrative purposes only, and in no way limit the scope of the portable structure 10. It should be noted that the is not limited to the specific embodiments pictured and described herein. Modifications and alterations from the described embodiments will occur to those skilled in the art without departure from the spirit and scope of the portable structure.

The invention claimed is:

1. A method of erecting a suite frame comprising:
   a. positioning a first ground rail on a ground surface;
   b. positioning a second ground rail on said ground surface such that said first and second ground rails are substantially parallel with respect to one another;
   c. engaging a first upright with said first and second ground rails, wherein said upright comprises:
      i. a first and second vertical rail section, wherein said first vertical rail section is engaged with said first ground rail at a first end of said first ground rail, and wherein said second vertical rail section is engaged with said second ground rail at a first end of said second ground rail;
      ii. an arch support, wherein a first end of said arch support is engaged with a second end of said first vertical rail section, and wherein a second end of said arch support is engaged with a second end of said second vertical rail section;
   d. engaging a vertical cable with said arch support;
   e. affixing a first and second outside floor support to said first vertical rail section, wherein said second outside floor support is affixed to said second vertical rail section, wherein said first and second outside floor supports are configured to support a portion of a floor sheet, and wherein said first outside floor support comprises:
      i. a floor support sleeve, wherein said floor support sleeve encompasses a portion of the exterior of said first vertical rail member;
      ii. a floor support clamp, wherein said floor support clamp is pivotally affixed to said floor support sleeve, and wherein a portion of said floor support clamp engages said first vertical rail member;
      iii. a floor support arm, wherein a first end of said floor support arm is engaged with said floor support clamp; and
      iv. a floor support platform, wherein said floor support platform is engaged with a second end of said floor support arm; and f. affixing an inside floor support affixed to said vertical cable, wherein said inside floor support is configured to support a second portion of said floor sheet.

2. The method according to claim 1 wherein said portable structure further comprises a third vertical rail member, wherein said third vertical rail member is engaged with said second vertical rail member.

3. The method according to claim 2 wherein said portable structure further comprises a fourth vertical rail member, wherein said fourth vertical rail member is engaged with said third vertical rail member and a pod.

4. The method according to claim 1 wherein said method further comprises the step of positioning at least one cocoon section placed over a portion of said suite frame.

5. The method according to claim 1 wherein said method is further defined as requiring no preparation of said ground surface.

6. The method according to claim 1 wherein said method further comprises the step of engaging a pod with said suite frame.

7. The method according to claim 6 wherein said pod is further defined as having a length, a width, and a height, and wherein said pod further comprises:

a. a first wall extending upward from said bottom portion;

b. a second wall extending upward from said bottom portion;

c. a third wall extending upward from said bottom portion, wherein said third wall intersects said first and second walls at a first end of said first and second walls;

d. a fourth wall extending upward from said bottom portion, wherein said fourth wall intersects said first and second walls at a second end of said first and second walls; and, e. a top portion engaged with the top surface of said first, second, third, and fourth walls.

8. The method according to claim 7 wherein said pod further comprises a generator on an interior portion thereof.

9. The method according to claim 7 wherein said pod further comprises an HVAC on an interior portion thereof.

10. The method according to claim 7 wherein said pod further comprises an exterior access panel on one of said walls.

11. The method according to claim 7 wherein said pod further comprises a control panel on an interior portion thereof.

12. The method according to claim 7 wherein said pod further comprises a breaker panel.

13. The method according to claim 7 wherein said pod further comprises a catwalk engaged with said top portion above said fourth wall.

* * * * *